US011867177B2

(12) United States Patent
Ino

(10) Patent No.: US 11,867,177 B2
(45) Date of Patent: Jan. 9, 2024

(54) PUMP DEVICE INCLUDING RETURN PASSAGE FOR RETURNING FLUID FROM DISCHARGE PASSAGE TO SUCTION PASSAGE

(71) Applicant: MIKUNI CORPORATION, Tokyo (JP)

(72) Inventor: Yasuhiro Ino, Iwate (JP)

(73) Assignee: MIKUNI CORPORATION, Tokyo (JP)

( * ) Notice: Subject to any disclaimer, the term of this patent is extended or adjusted under 35 U.S.C. 154(b) by 0 days.

(21) Appl. No.: 18/154,029

(22) Filed: Jan. 12, 2023

(65) Prior Publication Data

US 2023/0279855 A1 Sep. 7, 2023

(30) Foreign Application Priority Data

Mar. 3, 2022 (JP) ..... 2022-032607

(51) Int. Cl.

| | |
|---|---|
| ***F04C 15/06*** | (2006.01) |
| ***F04C 2/10*** | (2006.01) |
| ***F01M 1/02*** | (2006.01) |
| ***F04C 29/12*** | (2006.01) |
| ***F04C 14/24*** | (2006.01) |
| ***F04C 14/26*** | (2006.01) |

(52) U.S. Cl.

CPC ..... *F04C 2/103* (2013.01); *F01M 1/02* (2013.01); *F04C 29/12* (2013.01); *F01M 2001/0238* (2013.01)

(58) Field of Classification Search

CPC ..... F04C 2/103; F04C 15/06; F04C 14/24; F04C 14/26; F01M 1/02

See application file for complete search history.

(56) References Cited

U.S. PATENT DOCUMENTS

2016/0123323 A1* 5/2016 Naiki ..... F01C 21/108 418/9

FOREIGN PATENT DOCUMENTS

| | | |
|---|---|---|
| JP | 2007255335 | 10/2007 |
| JP | 2018053740 | 4/2018 |

* cited by examiner

*Primary Examiner* — Deming Wan

(74) *Attorney, Agent, or Firm* — JCIPRNET

(57) ABSTRACT

A pump device includes a housing, a pump element, and an on-off valve. The housing includes a suction passage defining a suction port at an upstream end, a discharge passage defining a discharge port at a downstream end, and a return passage returning a part of a fluid flowing through the discharge passage to midway of the suction passage. The pump element is accommodated in the housing and rotates around a predetermined axis to suck, pressurize, and discharge a fluid. The on-off valve opens and closes the return passage. In the suction passage upstream of an opening at which the return passage is opened to the suction passage, the housing includes a directional wall which directs a flow of a suction fluid sucked into the suction passage from the suction port to divert from a flow of a return fluid returned from the return passage.

16 Claims, 19 Drawing Sheets

PUMP DEVICE INCLUDING RETURN PASSAGE FOR RETURNING FLUID FROM DISCHARGE PASSAGE TO SUCTION PASSAGE

CROSS-REFERENCE TO RELATED APPLICATION

This application claims the priority benefit of Japan application serial no. 2022-032607, filed on Mar. 3, 2022. The entirety of the above-mentioned patent application is hereby incorporated by reference herein and made a part of this specification.

BACKGROUND

Technical Field

The disclosure relates to a pump device including a return passage for returning a fluid from a discharge passage to a suction passage, and more particularly, the disclosure relates to a pump device that is applied to an internal combustion engine of an outboard motor to suck, pressurize, and discharge oil (lubricating oil or hydraulic oil).

Related Art

As a conventional pump device, an oil pump has been known to include: a pump housing that has a suction passage, a discharge passage, and a drain passage communicating the suction passage with the discharge passage; a pump element that is accommodated in the pump housing and pressurizes and discharges sucked hydraulic oil; a spool valve (relief valve) that opens and closes the drain passage to return excess hydraulic oil in the discharge passage to the suction passage side; a suction pipe that is coupled to the pump housing to introduce hydraulic oil into the suction passage from outside; a flow regulating member that is fixed to an inner wall of the suction pipe to regulate the flow of hydraulic oil returned from the drain passage and the flow of hydraulic oil supplied from the suction pipe (for example, Patent Document 1: Japanese Patent Application Laid-Open No. 2007-255335).

In this oil pump, since the flow regulating member is only arranged in a region where the drain passage and a supply passage of the suction pipe intersect to regulate the flow, collision between the hydraulic oil returned from the drain passage and the hydraulic oil supplied from the supply passage of the suction pipe cannot be suppressed or prevented. Thus, suction resistance due to turbulence in the flows cannot be sufficiently reduced. Further, since the flow regulating member is formed as a dedicated component fixed to the suction pipe, the number of components increases and the cost increases.

As another pump device, a hydraulic circuit has been known to include: a housing that has a suction oil passage, a discharge oil passage, and a return oil passage communicating the suction oil passage with the discharge oil passage; a pump element (vane pump) that is accommodated in the housing and pressurizes and discharges sucked hydraulic oil; and a flow regulating member that regulates the flow of oil returned from the return oil passage to the suction oil passage (for example, Patent Document 2: Japanese Patent Application Laid-Open No. 2018-53740). The flow regulating member is formed as a seal plug that has an inclined surface curved to change the direction of the oil flow by approximately 90 degrees, and has a fixing part fitted and fixed to the housing.

In this hydraulic circuit, the flow regulating member only bends the oil flowing out of the return oil passage and guides it into the suction oil passage, and collision between the oil returned from the return oil passage and the oil flowing through the suction oil passage cannot be suppressed or prevented. Thus, suction resistance due to turbulence in the flows cannot be sufficiently reduced. Further, since the flow regulating member is a seal plug that is fitted into the housing, it is a component separate from the housing, which results in an increase in the number of components and an increase in cost.

SUMMARY

A pump device according to the disclosure includes a housing, a pump element, and an on-off valve. The housing includes a suction passage defining a suction port at an upstream end, a discharge passage defining a discharge port at a downstream end, and a return passage returning a part of a fluid flowing through the discharge passage to midway of the suction passage. The pump element is accommodated in the housing and rotates around a predetermined axis to suck, pressurize, and discharge a fluid. The on-off valve opens and closes the return passage. In the suction passage upstream of an opening at which the return passage is opened to the suction passage, the housing includes a directional wall which directs a flow of a suction fluid sucked into the suction passage from the suction port to divert from a flow of a return fluid returned from the return passage.

In the pump device, in the suction passage upstream of the opening at which the return passage is opened to the suction passage, the housing may include a weir part which protrudes from a bottom wall of the suction passage and defines a reservoir region storing a fluid in a region that includes the opening. The weir part may include an inclined surface forming an upward slope toward a downstream side to define the directional wall.

In the pump device, the opening of the return passage may be formed along a bottom wall of the reservoir region.

In the pump device, the return passage may be opened toward a downstream side of a position orthogonal to the suction passage.

In the pump device, in a predetermined region including the opening at which the return passage is opened to the suction passage, the housing may include a flow regulating wall protruding from a bottom wall of the reservoir region to regulate the return fluid returned from the return passage to flow along the suction passage.

In the pump device, the suction port may be opened downward in a vertical direction in a use state of being applied to an application target.

In the pump device, the discharge port may be opened upward in the vertical direction in the use state of being applied to the application target.

In the pump device, the housing may include a housing body which is opened upward in the vertical direction in the use state of being applied to the application target, and a housing cover which is coupled to close the housing body from above.

In the pump device, the housing body may include: a pump accommodating recess opened upward in the vertical direction to accommodate the pump element; a grooved passage opened upward in the vertical direction to define a part of the suction passage, the discharge passage, and the return passage; and the weir part formed in the grooved passage.

In the pump device, the housing cover may include a grooved passage opened downward in the vertical direction to define a part of the suction passage and the discharge passage.

In the pump device, the housing may include pump chamber suction ports for sucking a fluid into a pump chamber of the pump element at two end surfaces of the pump element in a direction of the axis.

In the pump device, the pump chamber suction ports may include: a one-end side pump chamber suction port formed to face one end surface of the pump element at a downstream end of the suction passage of the housing body; and an other-end side pump chamber suction port formed to face another end surface of the pump element at a downstream end of the suction passage of the housing cover.

In the pump device, the suction passage of the housing cover may include an inclined surface inclined in a same direction as the inclined surface of the weir part formed in the housing body.

In the pump device, the housing may be formed so that the suction passage and the discharge passage are arranged in a V-shape with the pump element as a boundary.

In the pump device, the housing may include the return passage and a valve accommodating part which accommodates the on-off valve in a region sandwiched between the suction passage and the discharge passage.

In the pump device, the pump element may include: an inner rotor which rotates integrally with a rotating shaft rotatably supported around the axis with respect to the housing; and an outer rotor which rotates in conjunction with the inner rotor.

In the pump device, the inner rotor and the outer rotor may be trochoidal rotors having a trochoidal tooth profile.

According to the pump device having the above configuration, turbulence in fluid flows and pressure loss can be suppressed and pump efficiency can be improved while achieving simplification of structure, reduction in the number of components, and cost reduction.

DESCRIPTION OF THE EMBODIMENTS

Embodiments of the disclosure provide a pump device capable of suppressing turbulence in fluid flows and pressure loss and improving pump efficiency while achieving simplification of structure, reduction in the number of components, and cost reduction.

Figure 1:
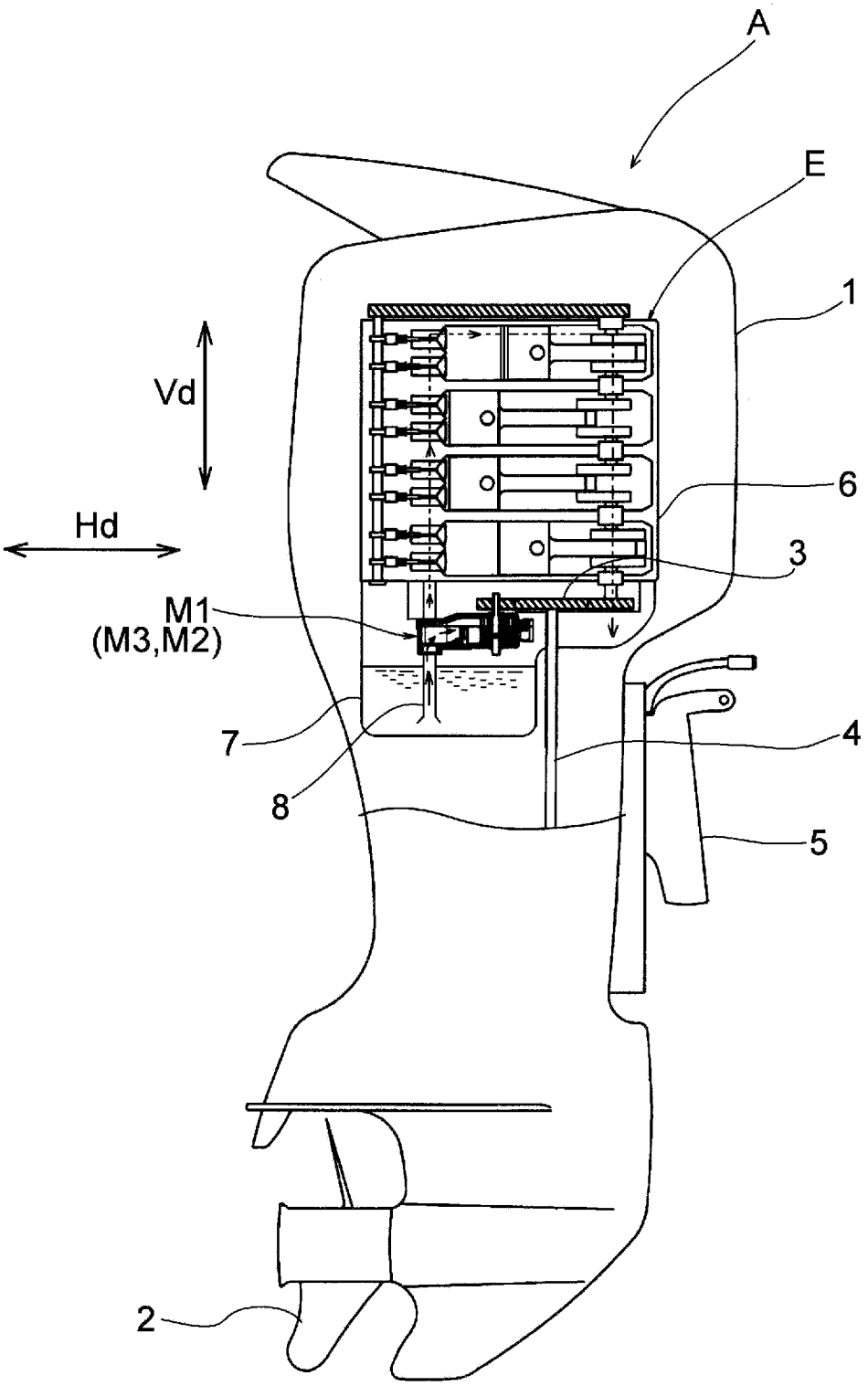
FIG. 1 is a schematic view showing a state in which a pump device of the disclosure is applied to an outboard motor as an application target.

Hereinafter, embodiments of the disclosure will be described with reference to the accompanying drawings. A pump device M1 according to a first embodiment is applied to an internal combustion engine E mounted on an outboard motor A as an application target. As shown in FIG. 1, the outboard motor A includes an internal combustion engine E, an engine cover 1 covering the internal combustion engine E, a propeller 2, a gear train 3 to which a rotational force of a crankshaft of the internal combustion engine E is transmitted, a drive shaft 4 which rotates integrally with one gear of the gear train 3 to transmit the rotational force to the propeller 2, a bracket 5 for attaching to a hull, etc.

As shown in FIG. 1, the internal combustion engine E includes an engine body 6, an oil pan 7 coupled below the engine body 6 to store oil as a fluid, and a pump device M1 attached to the engine body 6 inside the oil pan 7. Herein, in a use state of being applied to the outboard motor A, the pump device M1 sucks up the oil in the oil pan 7 in a vertical direction Vd via an oil strainer 8, discharges pressurized oil upward in the vertical direction Vd through a suction passage and a discharge passage extending in a horizontal direction Hd, and sucks up again the oil that has flowed through the engine body 6 as indicated by a double-dot dashed line and returned to the oil pan 7 to circulate the oil.

Figure 2:
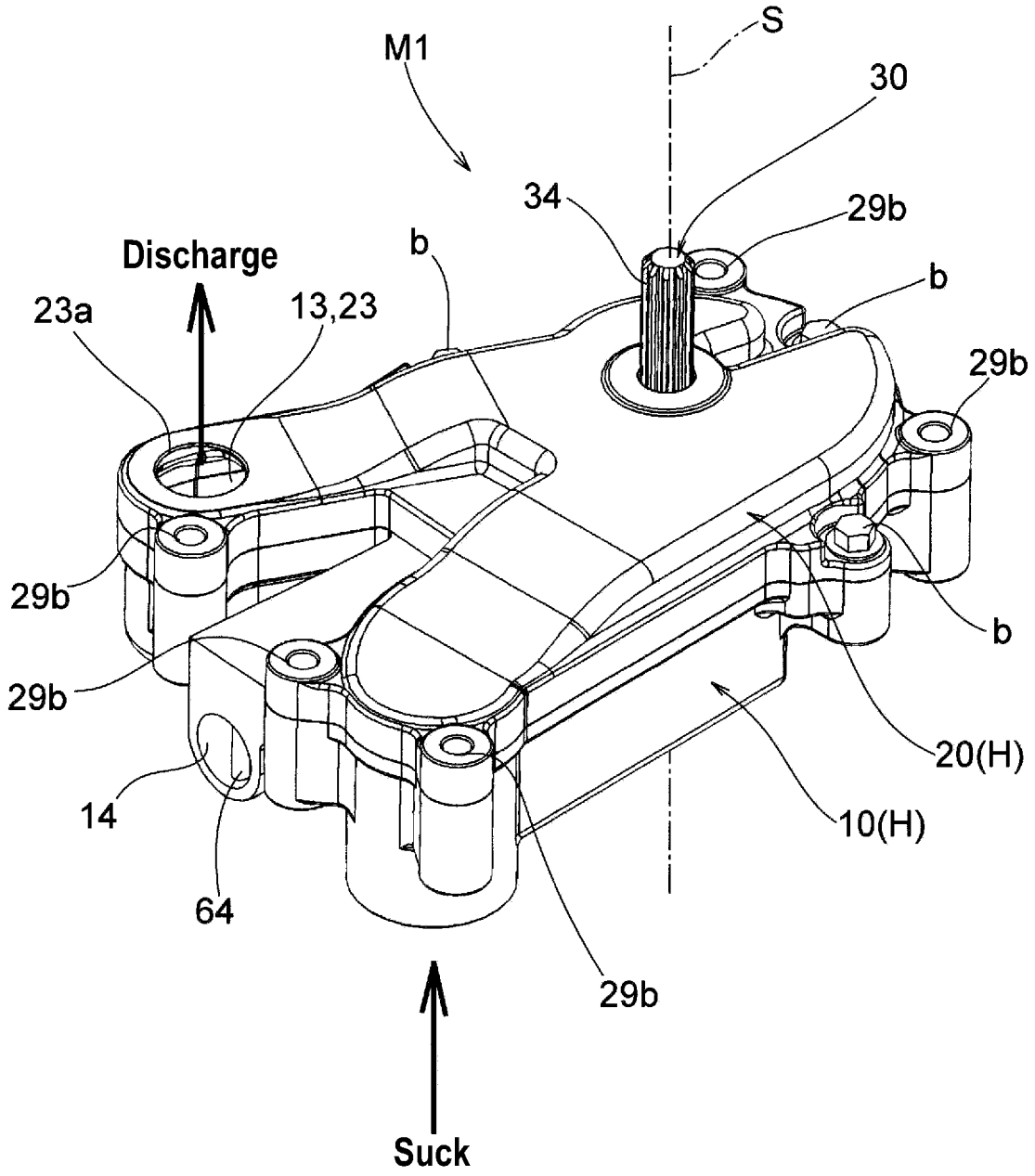
FIG. 2 is an external perspective view showing a pump device according to a first embodiment of the disclosure
Figure 3:
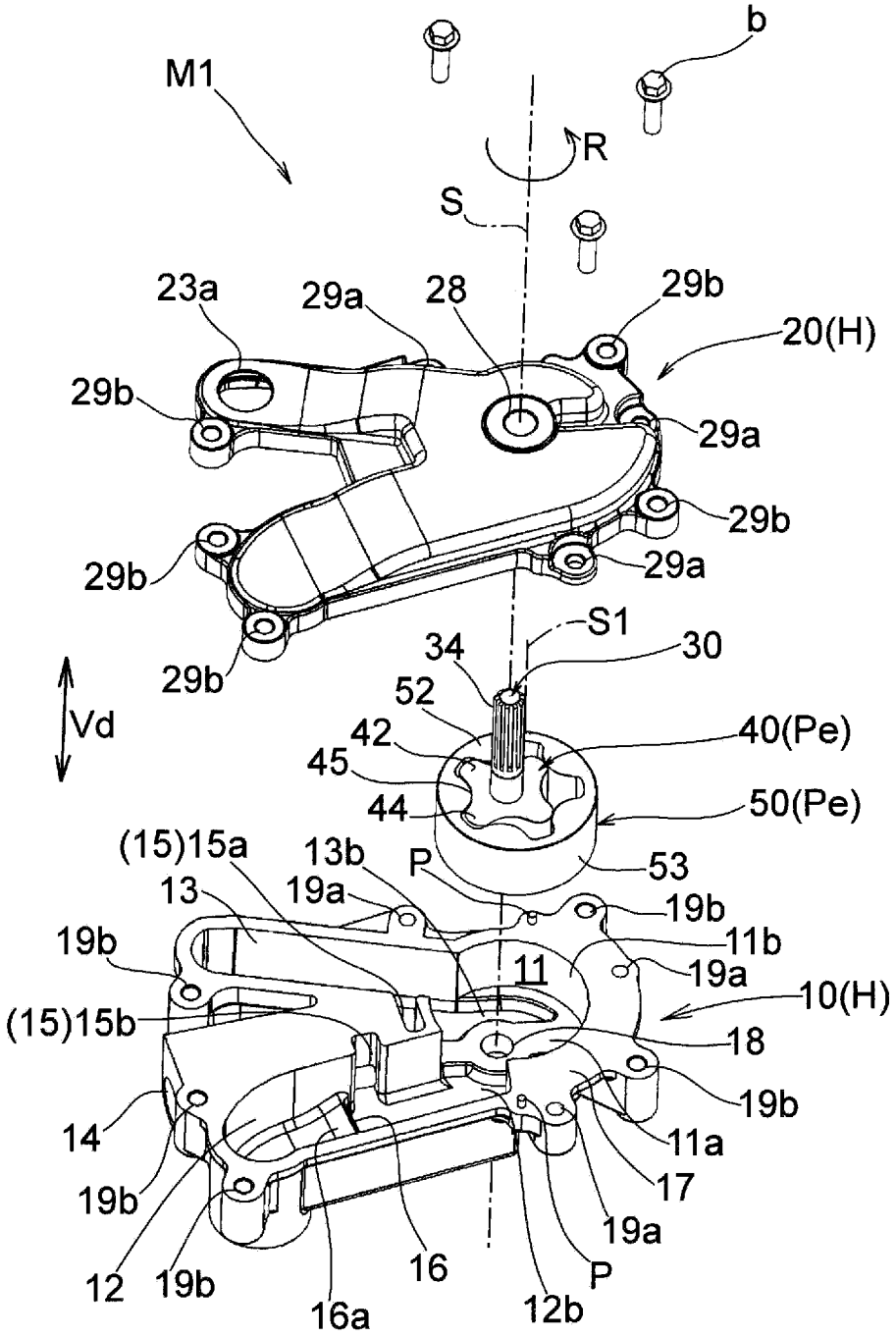
FIG. 3 is an exploded perspective view of the pump device according to the first embodiment, viewed obliquely from above.
Figure 4:
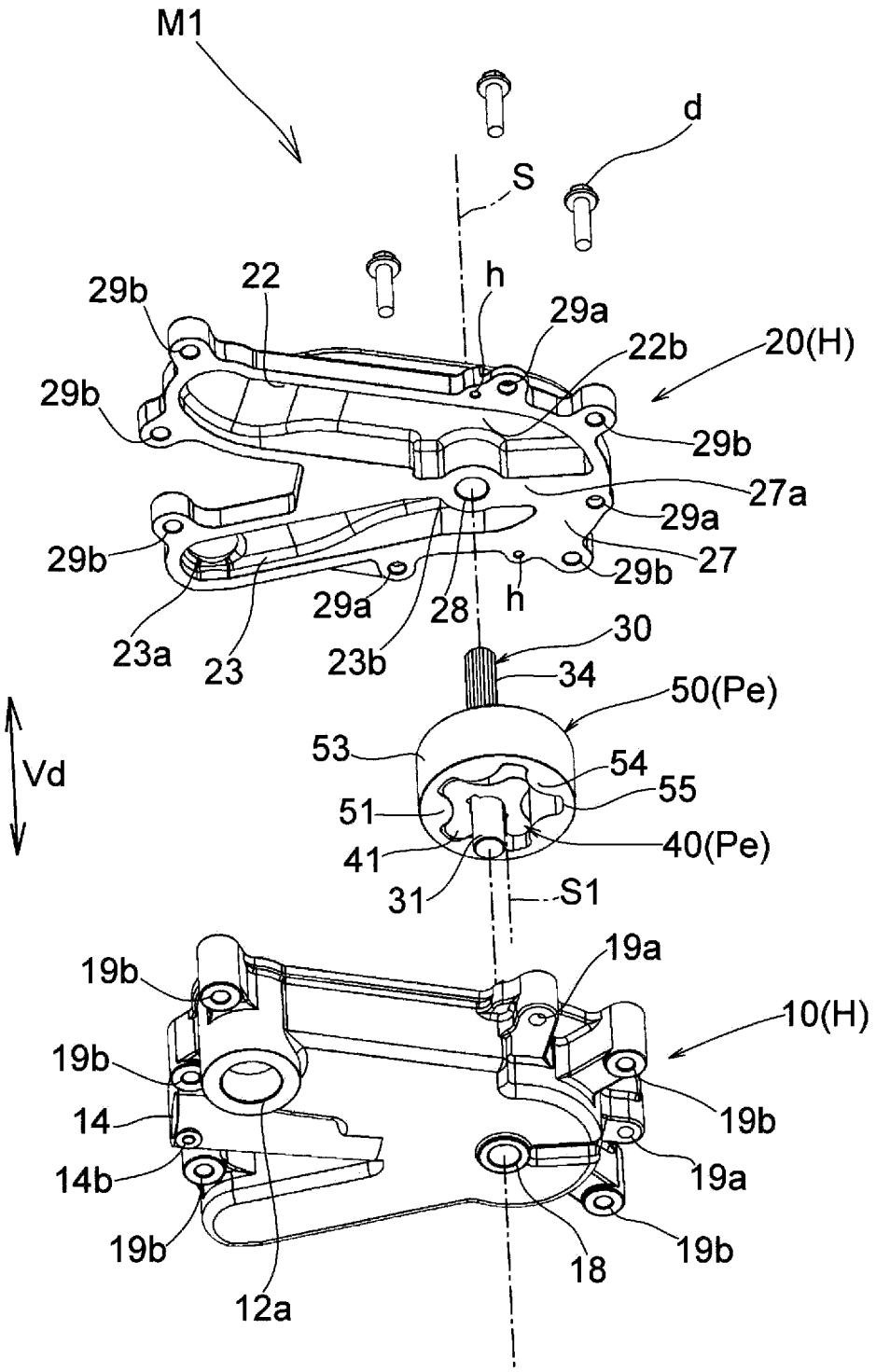
FIG. 4 is an exploded perspective view of the pump device according to the first embodiment, viewed obliquely from below.

As shown in FIG. 2 to FIG. 4, the pump device M1 includes a housing body 10 and a housing cover 20 as a housing H, a rotating shaft 30 centered on an axis S, an inner rotor 40 and an outer rotor 50 as a pump element Pe, an on-off valve 60, and screws b fastening the housing cover 20 to the housing body 10.

The housing body 10 is formed of a metal material such as steel, cast iron, sintered steel, and aluminum alloy into a bottomed concave shape that is opened on one side in the direction of the axis S, i.e., opened upward in the vertical direction Vd in the use state of being applied to the outboard motor A. As shown in FIG. 3 and FIG. 4, the housing body 10 includes a pump accommodating recess 11, a suction passage 12, a discharge passage 13, a valve accommodating part 14, a return passage 15, a weir part 16 forming a directional wall 16*a*, a joint surface 17, a bearing hole 18, three screw holes 19*a*, and five insertion holes 19*b*.

The pump accommodating recess 11 is a region that accommodates the pump element Pe (the inner rotor 40 and the outer rotor 50), and includes a thrust surface 11*a* that receives one-end surfaces 41 and 51 of the inner rotor 40 and the outer rotor 50, and an inner peripheral surface 11*b* that supports an outer peripheral surface 53 of the outer rotor 50 rotatably around an axis S1 parallel to the axis S.

The suction passage 12 is formed as a grooved passage having a substantially rectangular cross-section that is opened upward in the vertical direction Vd in the use state of being applied to the outboard motor A, and is formed to extend in the horizontal direction Hd from a suction port 12*a* opened downward in the vertical direction Vd defined at its upstream end to a one-end side pump chamber suction port 12*b* facing the pump accommodating recess 11.

The discharge passage 13 is formed as a grooved passage having a substantially rectangular cross-section that is opened upward in the vertical direction Vd in the use state of being applied to the outboard motor A, and is formed to extend in the horizontal direction Hd from its downstream end (a position opposed to a discharge port 23*a* opened upward in the vertical direction Vd formed in the housing cover 20) to a one-end side pump chamber discharge port 13*b* facing the pump accommodating recess 11.

Figure 7:
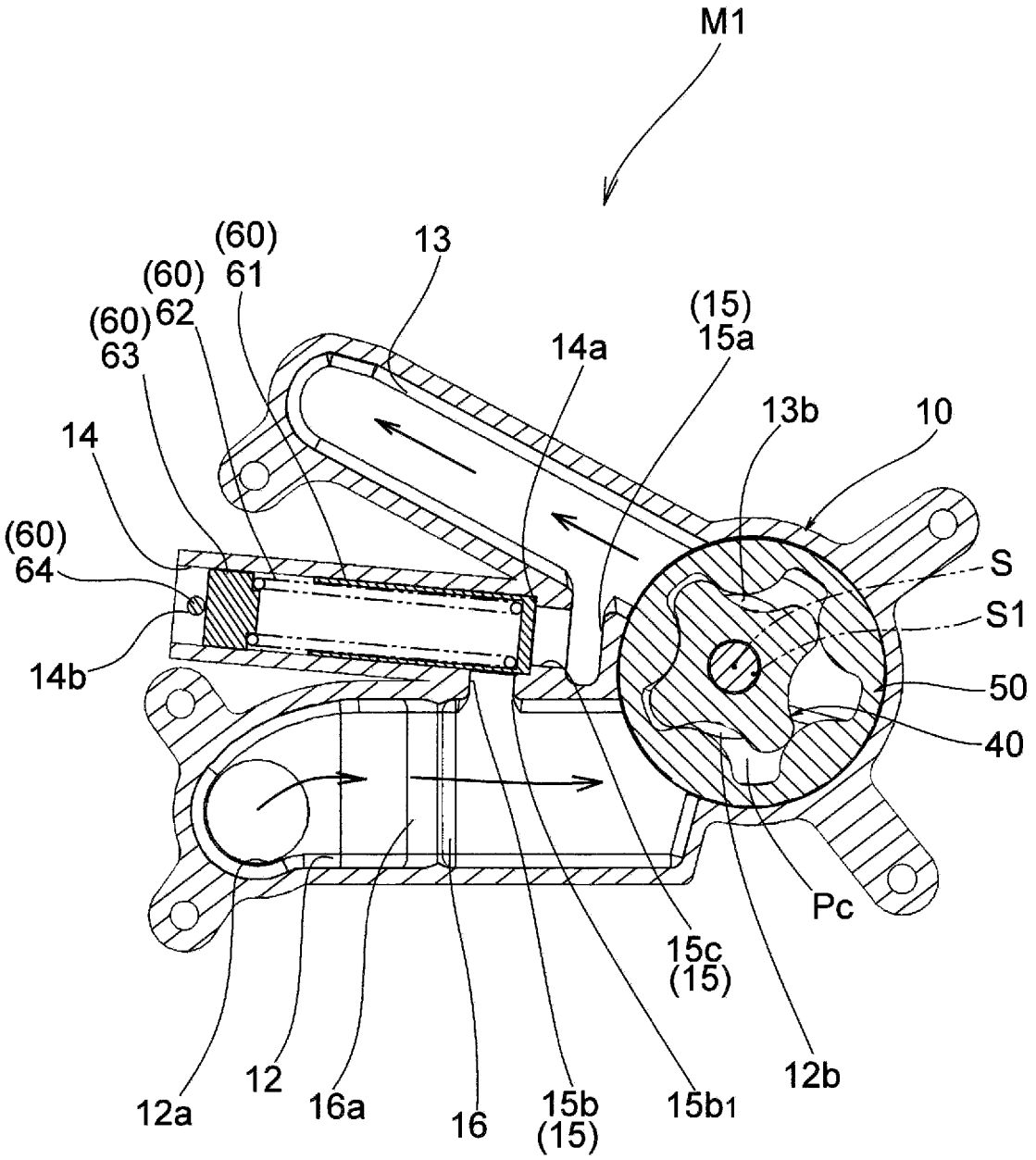
FIG. 7 is a cross-sectional view of the pump device according to the first embodiment taken along a plane (a horizontal plane in the state of being applied to the application target) perpendicular to an axis of a rotating shaft, with an on-off valve being closed.

As shown in FIG. 3 and FIG. 7, the valve accommodating part 14 is formed as a drill hole having a circular cross-section extending in the horizontal direction Hd in a region sandwiched between the suction passage 12 and the discharge passage 13, and includes a stopper 14*a* in an annular shape against which a valve body 61 of the on-off valve 60 abuts, and a pin hole 14*b* into which a stopper pin 64 is fitted. The valve accommodating part 14 slidably guides the valve body 61 of the on-off valve 60 and functions as a part of the return passage 15.

As shown in FIG. 3 and FIG. 7, the return passage 15 is compose of an upstream passage 15*a* and a downstream passage 15*b* that form grooved passages having a substantially rectangular cross-section opened upward in the vertical direction Vd in the use state of being applied to the outboard motor A, and an intermediate passage 15*c* defined by a part of the valve accommodating part 14 between the upstream passage 15*a* and the downstream passage 15*b*. The upstream passage 15*a* is opened midway in the discharge passage 13, and the downstream passage 15*b* is opened midway in the suction passage 12. With the intermediate passage 15*c* being opened by the on-off valve 60, the upstream passage 15*a* and the downstream passage 15*b* communicate with each other, and a part of the oil flowing through the discharge passage 13 is returned to the suction passage 12. Herein, as shown in FIG. 5 to FIG. 9, the downstream passage 15*b* of the return passage 15 has an opening 15*b*1 that is oriented orthogonal to the suction passage 12 and is opened to the suction passage 12. At the opening 15*b*1, a passage having an area corresponding to the area (a cross-sectional area of an oil flow flowing out of the hole opened and closed by the valve body 61) of a communication hole communicating with the intermediate passage 15*c* is defined as a region that intersects with the suction passage 12, and the opening 15*b*1 is formed along a bottom wall 12*c* of the suction passage 12 located downstream of the weir part 16, i.e., along the bottom wall 12*c* of a reservoir region Sa.

Figure 6:
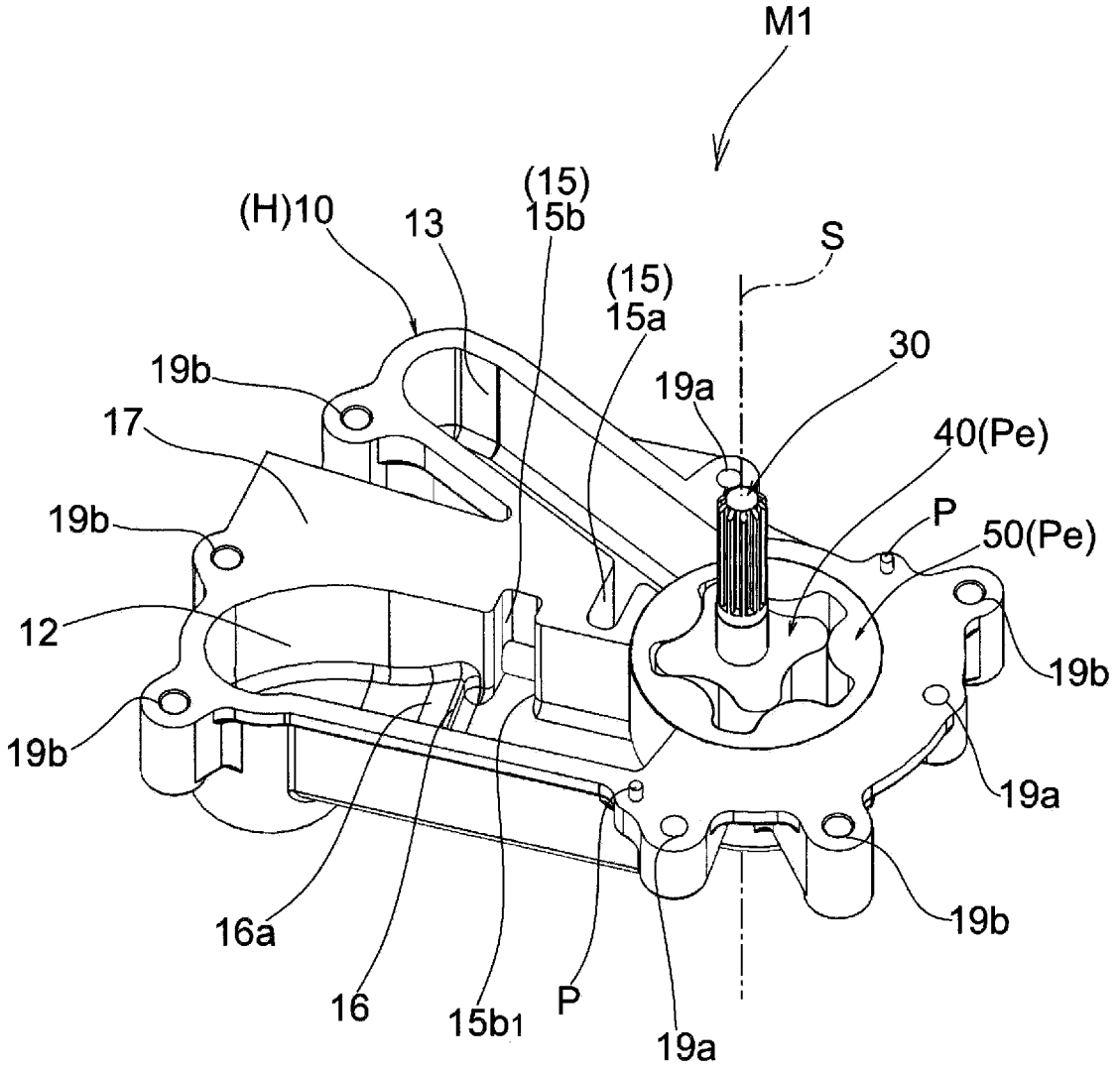
FIG. 6 is a perspective view of the pump device according to the first embodiment, viewed obliquely from above with a housing cover constituting a housing being removed.
Figure 9:
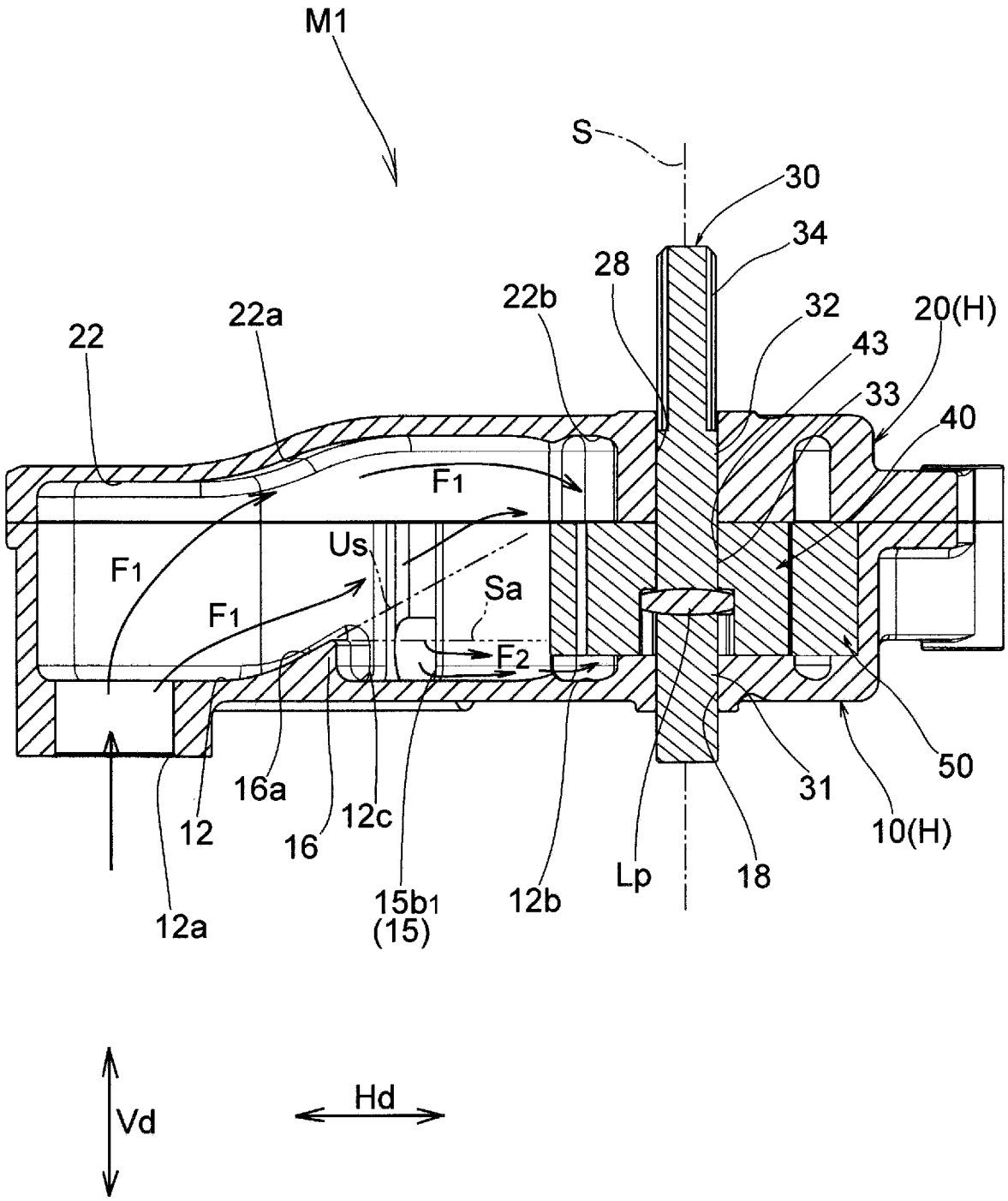
FIG. 9 is a cross-sectional view showing a state in which a region of a suction passage is cut in a vertical direction when the pump device according to the first embodiment is applied to the application target.

As shown in FIG. 6 and FIG. 9, in the suction passage 12 upstream of the opening 15*b*1 at which the return passage 15 (the downstream passage 15*b*) is opened to the suction passage 12, the weir part 16 is formed to protrude from the bottom wall 12*c* of the suction passage 12 by a predetermined height. Further, the weir part 16 defines a reservoir region Sa in which the oil is stored in a region including the opening 15*b*1 downstream of the weir part 16. By forming the reservoir region Sa in this manner, it is possible to prevent all the oil from dropping out of the pump element Pe in a stopped state of the internal combustion engine E. Thus, the next time the internal combustion engine E is started, the pump element Pe can be smoothly operated.

As shown in FIG. 9, the weir part 16 defines a directional wall 16*a* whose upper contour is formed as an inclined surface forming an upward slope Us toward the downstream side of the suction passage 12. The directional wall 16*a* serves to direct suction oil obliquely upward so that, in the suction passage 12 upstream of the opening 15*b*1 at which the return passage 15 is opened to the suction passage 12, the flow of suction oil as a suction fluid sucked into the suction passage 12 from the suction port 12*a* diverts from the flow of return oil as a return fluid returned from the return passage 15. Herein, "to divert" is synonymous with "to deviate" or "to bias" and is meant to orient the flow of suction oil so as not to directly face the flow of return oil to avoid direct collision of the suction oil with the return oil. Specifically, as shown in FIG. 9, a streamline $F_1$ of the suction oil is oriented in a direction away from a streamline $F_2$ of the return oil, i.e., obliquely upward toward the downstream side, along the slope Us of the inclined surface of the directional wall 16*a*, so that the streamline $F_1$ of the suction oil does not directly face the streamline $F_2$ of the return oil flowing out of the opening 15*b*1 (the region of the communication hole communicating with the intermediate passage 15*c*) of the return passage 15.

As shown in FIG. 3 and FIG. 6, the joint surface 17 forms a flat surface in a direction perpendicular to the axis S so that a joint surface 27 of the housing cover 20 is joined from the direction of the axis S. Further, two positioning pins P for positioning the housing cover 20 are provided on the joint surface 17 in a region around the pump accommodating recess 11.

As shown in FIG. 3 and FIG. 9, in the region of the pump accommodating recess 11, the bearing hole 18 is formed in a cylindrical shape centered on the axis S to rotatably support a one-end part 31 of the rotating shaft 30. The three screw holes 19*a* serve for screwing in the screws b which couple the housing cover 20 to the housing body 10 around the pump accommodating recess 11 in the region of the joint surface 17. The five insertion holes 19*b* serve for inserting bolts (not shown) that couple the housing H (the housing body 10 and the housing cover 20) to the engine body 6 in the region of the joint surface 17.

That is, the housing body 10 is formed to include the pump accommodating recess 11 that is opened to one side (upward in the vertical direction Vd) in the direction of the axis S to accommodate the pump element Pe, the grooved passage that is opened on one side (upward in the vertical direction Vd) in the direction of the axis S to define the suction passage 12, the discharge passage 13, and a part (the upstream passage 15*a* and the downstream passage 15*b*) of the return passage 15, and the weir part 16 that protrudes from the bottom wall 12*c* of the suction passage 12 forming the grooved passage. Accordingly, since the housing body 10 is opened on one side (upward in the vertical direction Vd) in the direction of the axis S, when molding the housing body 10 with a mold or the like, the pump accommodating recess 11, the suction passage 12, the discharge passage 13, and the return passage 15 (the upstream passage 15*a* and the downstream passage 15*b*) can be easily formed by die-cutting, and in particular, the weir part 16 and the directional wall 16*a* can be easily formed integrally in the suction passage 12 forming the grooved passage.

The housing cover 20 is coupled to the housing body 10 to close the housing body 10, and is formed of a material such as steel, cast iron, sintered steel, and aluminum alloy into a bottomed concave shape that is opened on another side in the direction of the axis S, i.e., opened downward in the vertical direction Vd in the use state of being applied to the outboard motor A. As shown in FIG. 3 and FIG. 4, the housing cover 20 includes a suction passage 22, a discharge passage 23, a joint surface 27, a bearing hole 28, three circular holes 29*a*, and five insertion holes 29*b*.

Figure 5:
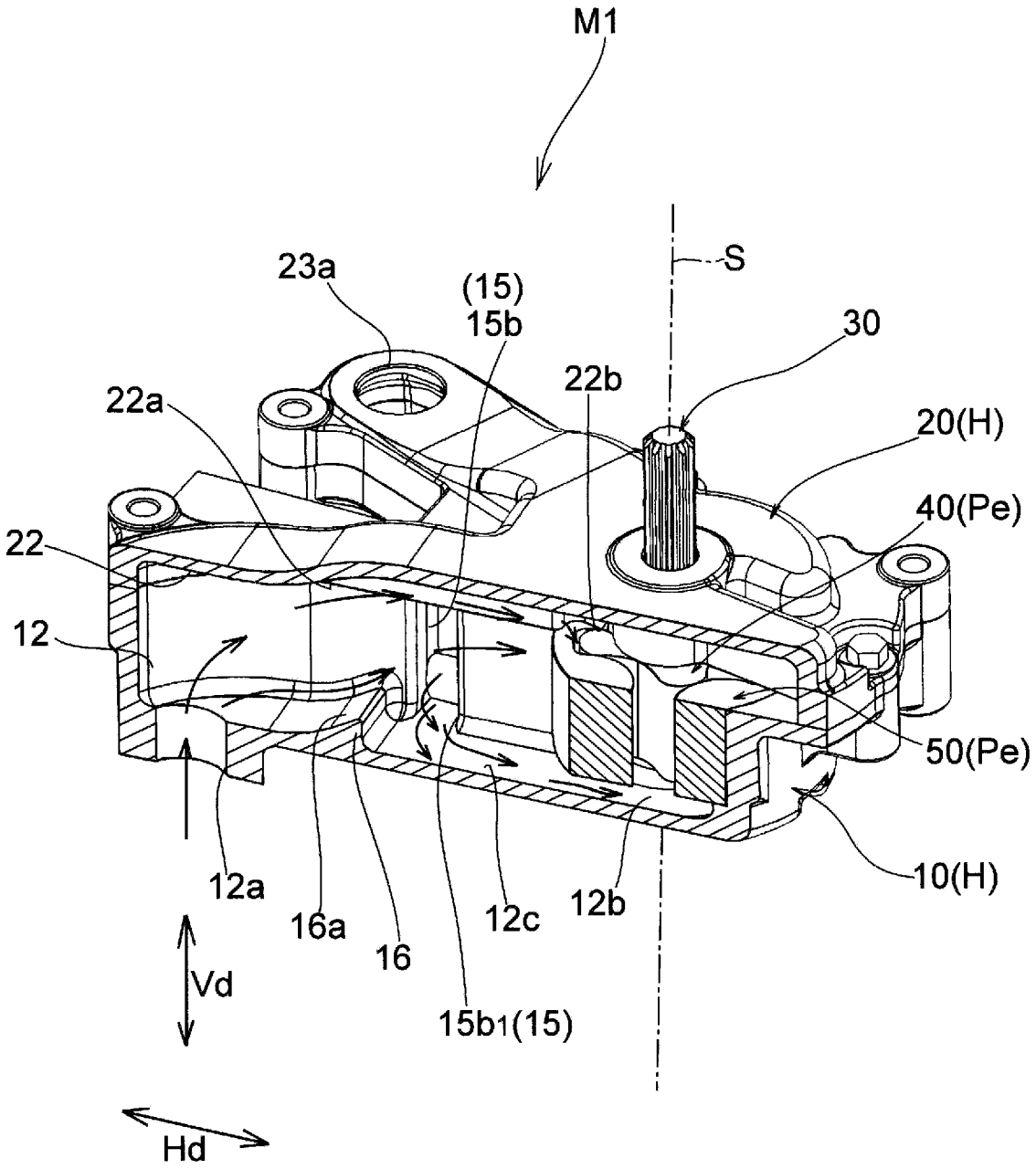
FIG. 5 is a perspective cross-sectional view of a part of the pump device according to the first embodiment.

The suction passage 22 is formed as a grooved passage having a substantially rectangular cross-section that is opened downward in the vertical direction Vd in the use state of being applied to the outboard motor A, and is formed to extend in the horizontal direction Hd from its upstream end (a position opposed to the suction port 12*a* opened downward in the vertical direction Vd formed in the housing body 10) to an other-end side pump chamber suction port 22*b* facing the pump accommodating recess 11 of the housing body 10. As shown in FIG. 5 and FIG. 9, the suction passage 22 has an inclined surface 22*a* that is inclined in the same direction as the inclined surface forming the upward slope Us as the directional wall 16*a* of the weir part 16 formed in the suction passage 12 of the housing body 10, and the suction passage 22 is formed so that a passage area downstream of the inclined surface 22*a* is larger. By forming the inclined surface 22*a* inclined in the same direction as the directional wall 16*a* in this manner, even though the weir part 16 and the directional wall 16*a* are provided, the passage area of the suction passages 12 and 22 is not narrowed, and the oil sucked from the suction port 12*a* can be guided along the inner wall surface of the suction passage 22 to the other-end side pump chamber suction port 22*b*.

The discharge passage 23 is formed as a grooved passage having a substantially rectangular cross-section that is opened downward in the vertical direction Vd in the use state of being applied to the outboard motor A, and is formed to extend in the horizontal direction Hd from the discharge port 23*a* opened upward in the vertical direction Vd defined at its downstream end to an other-end side pump chamber discharge port 23*b* facing the pump accommodating recess 11.

As shown in FIG. 4, the joint surface 27 forms a flat surface in a direction perpendicular to the axis S to be joined to the joint surface 17 of the housing body 10 from the direction of the axis S. Further, two positioning holes h into which the positioning pins P of the housing body 10 are fitted are formed in the joint surface 27 in a region opposed to the periphery of the pump accommodating recess 11. Further, the joint surface 27 defines a thrust surface 27*a* that receives other-end surfaces 42 and 52 of the inner rotor 40 and the outer rotor 50 in a region around the bearing hole 28.

As shown in FIG. 4 and FIG. 9, in a region opposed to the pump accommodating recess 11, the bearing hole 28 is formed in a cylindrical shape centered on the axis S to rotatably support an intermediate part 32 of the rotating shaft 30. In a region of the joint surface 27 opposed to the periphery of the pump accommodating recess 11, the three circular holes 29*a* are formed to pass the screws b which couple the housing cover 20 to the housing body 10. In the region of the joint surface 27, the five insertion holes 29*b* are formed to insert bolts (not shown) that couple the housing H (the housing body 10 and the housing cover 20) to the engine body 6.

The rotating shaft 30 is formed of a steel material or the like into a columnar shape extending in the direction of the axis S. As shown in FIG. 9, with a one-end part 31 fitted into the bearing hole 18 of the housing body 10 and an intermediate part 32 fitted into the bearing hole 28 of the housing cover 20, the rotating shaft 30 is supported rotatably around the axis S with respect to the housing H. Further, the rotating shaft 30 is assembled so that a fitting part 33 between the one-end part 31 and the intermediate part 32 is fitted into a fitting hole 43 of the inner rotor 40 to rotate integrally with the inner rotor 40 via a lock pin Lp. Further, at an other-end part, the rotating shaft 30 includes a connecting part 34 to which one gear of the gear train 3 is connected.

Figure 8:
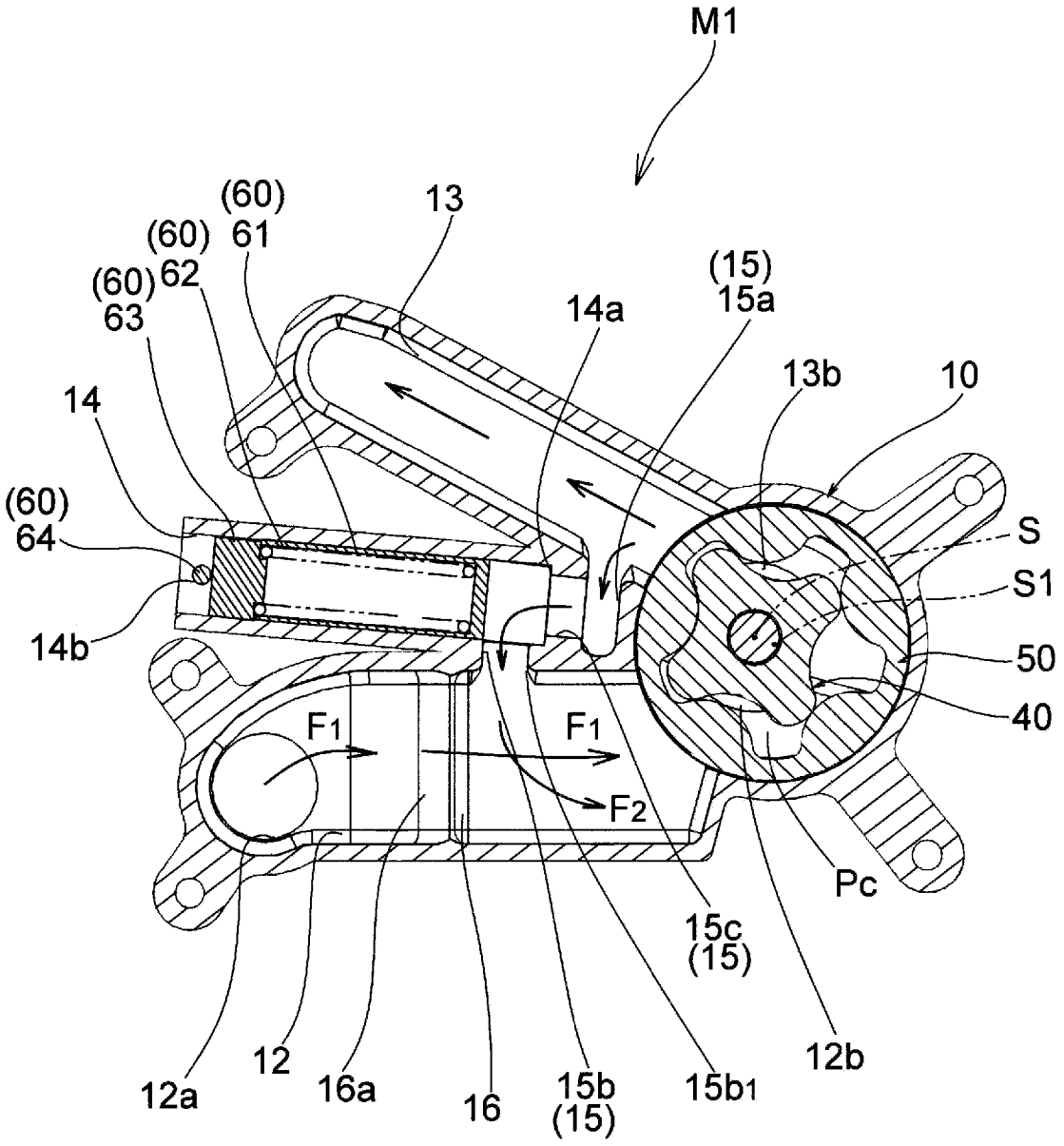
FIG. 8 is a cross-sectional view of the pump device shown in FIG. 7, with the on-off valve being opened.

As shown in FIG. 3, FIG. 7, and FIG. 8, the pump element Pe is arranged in the pump accommodating recess 11 of the housing body 10 and defines a pump chamber Pc that expands and contracts to exert a pump action including a suction stroke, a pressurization stroke, and a discharge stroke on oil as a fluid. Herein, the inner rotor 40 and the outer rotor 50 are trochoidal rotors having a trochoidal tooth profile with four blades and five nodes.

The inner rotor 40 is formed of a metal material such as steel or sintered steel as an external gear having a tooth profile in a trochoid curve, and includes a one-end surface 41 sliding on the thrust surface 11*a* of the housing body 10, an other-end surface 42 sliding on the thrust surface 27*a* of the housing cover 20, a fitting hole 43 into which the rotating shaft 30 is fitted, four protrusions 44, and four recesses 45. As shown in FIG. 3, the inner rotor 40 rotates on the axis S in the direction of an arrow R integrally with the rotating shaft 30.

The outer rotor 50 is formed of a metal material such as steel or sintered steel as an internal gear having a tooth profile that can be meshed with the inner rotor 40, and includes a one-end surface 51 sliding on the thrust surface 11*a* of the housing body 10, an other-end surface 52 sliding on the thrust surface 27*a* of the housing cover 20, an outer peripheral surface 53 in a cylindrical shape centered on the axis S1, five protrusions 54, and five recesses 55. The outer peripheral surface 53 slidably contacts the inner peripheral surface 11*b* of the housing body 10. The five protrusions 54 and the five recesses 55 are formed to partially mesh with the four protrusions 44 and the four recesses 45 of the inner rotor 40.

While linked with the rotation of the inner rotor 40 rotating on the axis S, the outer rotor 50 rotates on the axis S1 in the same direction as the inner rotor 40 at a lower speed than the inner rotor 40. Further, with the inner rotor 40 and the outer rotor 50 rotating while partially meshing with each other, the pump chamber Pc which expands and contracts is defined between the two, and a pump action including a suction stroke, a pressurization stroke, and a discharge stroke is continuously generated.

As shown in FIG. 7 and FIG. 8, the on-off valve 60 is composed of a valve body 61, a biasing spring 62, a lid member 63, and a stopper pin 64. The valve body 61 has a bottomed cylindrical shape and is slidably inserted into the valve accommodating part 14 of the housing body 10. The biasing spring 62 is a compression type coil spring and biases the valve body 61 in a valve closing direction. The lid member 63 is fitted into the valve accommodating part 14 to compress the biasing spring 62 to a predetermined compression amount and close the biasing spring 62. The stopper pin 64 is fitted into the pin hole 14*b* of the housing body 10 to fix the lid member 63 inside the valve accommodating part 14.

In the on-off valve 60, when a discharge pressure of the oil discharged from the pump element Pe exceeds a predetermined level, as shown in FIG. 8, the valve body 61 opens the return passage 15 against the biasing force of the biasing spring 62 to turn into a valve open state, and a part of the oil flowing through the discharge passages 13 and 23 returns, as a return fluid, from the return passage 15 (the upstream passage 15*a*, the intermediate passage 15*c*, and the downstream passage 15*b*) to the suction passages 12 and 22. On the other hand, when the discharge pressure drops to the predetermined level or below, due to the biasing force of the biasing spring 62, the valve body 61 closes the valve and stops return of the oil. Herein, since the on-off valve 60 is built in the housing body 10, compared to the case where it is arranged outside the housing H, simplification and miniaturization of the device can be achieved.

As described above, in the pump device M1 according to the first embodiment, the housing H includes the housing body 10 which is opened upward in the vertical direction Vd in the use state of being applied to the outboard motor A, and the housing cover 20 which is connected to close the housing body 10 from above. Then, a suction passage and a discharge passage forming cylindrical passages in the housing H are formed by the suction passages 12 and 22 and the discharge passages 13 and 23 forming grooved passages in the housing body 10 and the housing cover 20. By making the housing H a two-part structure in this manner, in the suction passage 12 forming a grooved passage, the weir part 16 and the directional wall 16*a* protruding from the bottom wall 12*c* can be easily formed integrally as a part of the housing body 10.

Further, in the suction passage 12 upstream of the opening 15*b*1 at which the return passage 15 is opened to the suction passages 12 and 22, the housing H has the directional wall 16*a* which directs the flow of the suction oil (suction fluid) sucked into the suction passages 12 and 22 from the suction port 12*a* to divert from the flow of the return oil (return fluid) returned from the return passage 15.

That is, as indicated by the streamline $F_1$ in FIG. 9, the suction oil sucked from the suction port 12*a* flows into the suction passages 12 and 22, is changed in direction to a substantially horizontal direction, is directed obliquely upward by the directional wall 16*a*, and is guided mainly along the inner wall surface of the suction passage 22 to reach the other-end side pump chamber suction port 22*b*. On the other hand, as indicated by the streamline $F_2$ in FIG. 8 and FIG. 9, the return oil returned from the opening 15*b*1 of the return passage 15 actively flows out into the reservoir region Sa in the suction passage 12, is changed in direction along the suction passage 12, and is guided mainly along the bottom wall 12*c* of the suction passage 12 to reach the one-end side pump chamber suction port 12*b*. Accordingly, since the suction oil (the streamline $F_1$) is diverted to flow upward by the directional wall 16*a* so as not to collide directly with the return oil (the streamline $F_2$), it is possible to suppress or prevent turbulence in the flow due to collision between the oils. As a result, pressure loss in the suction passages 12 and 22 can be reduced, and pump efficiency can be improved.

Further, since the weir part 16 serves to define the reservoir region Sa in which oil is stored, and also the upper surface forming its contour is formed as an inclined surface forming the upward slope Us toward the downstream side to function as the directional wall 16*a*, compared to the case where the weir part and the directional wall are provided separately, simplification of the structure in the suction passages 12 and 22 and reduction of pressure loss can be achieved. Further, as shown in FIG. 9, the opening 15*b*1 of the return passage 15 is opened and formed along the bottom wall 12*c* of the reservoir region Sa defined on the downstream side of the weir part 16 of the suction passage 12 of the housing body 10. Accordingly, the return oil returned from the opening 15*b*1 of the return passage 15 can be actively flowed to the reservoir region Sa which is lower than the height of the weir part 16. As a result, it is possible to more effectively suppress or prevent collision between the return oil and the suction oil sucked from the suction port 12*a*.

Further, since the suction port 12*a* is formed to be opened downward in the vertical direction Vd in the use state of being applied to the outboard motor A as the application target, the oil in the oil pan 7 located below is vertically sucked up and changed in direction along the inner wall surface of the suction passage 22, and the flow of suction oil can be actively biased and flowed upward in the suction passages 12 and 22. Further, since the discharge port 23*a* is formed to be opened upward in the vertical direction Vd in the use state of being applied to the outboard motor A as the application target, a suction pipe (e.g., the oil strainer 8) connected to the suction port 12*a* and a discharge pipe connected to the discharge port 23*a* can be arranged in the same direction, and the components in the region where the pump device M1 is attached can be collectively arranged so as not to spread in the lateral direction (horizontal direction).

Further, the housing H has the pump chamber suction ports for sucking oil into the pump chamber Pc of the pump element Pe at two end surfaces of the pump element Pe in the direction of the axis S. That is, the pump chamber suction ports include the one-end side pump chamber suction port 12*b* formed to face the one-end surfaces 41 and 51 of the pump element Pe at the downstream end of the suction passage 12 of the housing body 10, and the other-end side pump chamber suction port 22*b* formed to face the other-end surfaces 42 and 52 of the pump element Pe at the downstream end of the suction passage 22 of the housing cover 20. Thus, while suppressing collision between the suction oil (the streamline $F_1$) and the return oil (the streamline $F_2$), it is possible to actively guide the suction oil (the streamline $F_1$) to the other-end side pump chamber suction port 22*b* and actively guide the return oil (the streamline $F_2$) to the one-end side pump chamber suction port 12*b*. Accordingly, pressure loss in the suction passages 12 and 22 can be suppressed, and occurrence of cavitation, especially at high rotational speeds, can be prevented.

Further, as shown in FIG. 3, FIG. 4, and FIG. 7, the housing H is formed so that the suction passages 12 and 22 and the discharge passages 13 and 23 are arranged in a V-shape with the pump element Pe as a boundary. In the region sandwiched between the suction passage 12 and the discharge passage 13, the housing body 10 is formed to include the return passage 15 and the valve accommodating part 14 accommodating the on-off valve 60. Accordingly, it is possible to consolidate the components, narrow the width in the plane direction perpendicular to the axis S, reduce the thickness in the direction of the axis S, and reduce the size of the entire device.

Next, the operation of the pump device M1 applied to the internal combustion engine E mounted on the outboard motor A will be briefly described. When the internal combustion engine E is started and the inner rotor 40 rotates in the direction of the arrow R via the gear train 3 and the rotating shaft 30, the outer rotor 50 is linked and rotates in the same direction, and a pump action is generated due to expansion and contraction of the pump chamber Pc. Then, the oil that has flowed from the suction port 12*a* flows through the suction passages 12 and 22 and is sucked into the pump chamber Pc from the pump chamber suction ports (the one-end side pump chamber suction port 12*b* and the other-end side pump chamber suction port 22*b*) arranged at the two end surfaces of the pump element Pe. Then, due to the pump action of the pump element Pe, pressurized oil is pushed out into the discharge passages 13 and 23 from the pump chamber discharge ports (the one-end side pump chamber discharge port 13*b* and the other-end side pump chamber discharge port 23*b*) arranged at the two end surfaces of the pump element Pe.

Herein, when the pressure of the pressurized oil is at a predetermined level or below, the on-off valve 60 is in a valve closed state. Thus, as shown in FIG. 7, the pressurized oil is discharged from the discharge port 23*a* without passing through the return passage 15 and supplied to a supply destination in the internal combustion engine E. In this flow state, in the suction passages 12 and 22, since return oil does not flow from the return passage 15, the suction oil that has flowed from the suction port 12*a* flows toward the pump chamber Pc with the flow undisturbed.

On the other hand, when the pressure of the pressurized oil exceeds the predetermined level, the on-off valve 60 turns into the valve open state. Thus, as shown in FIG. 8 and FIG. 9, the pressurized oil is discharged from the discharge port 23*a* and supplied to the supply destination in the internal combustion engine E, and also a part of the pressurized oil is returned to the suction passages 12 and 22 through the return passage 15 (the upstream passage 15*a*, the intermediate passage 15*c*, and the downstream passage 15*b*). In this flow state, the return oil returned from the return passage 15 into the suction passages 12 and 22 actively flows mainly into the reservoir region Sa defined behind the weir part 16, afterwards, is changed in direction to the direction of the suction passage 12 and flows along the bottom wall 12*c*, and then flows into the pump chamber Pc from the one-end side pump chamber suction port 12*b*.

Further, the suction oil flowing from the suction port 12*a* is directed obliquely upward by the directional wall 16*a*, mainly flows along the inner wall surface and the inclined surface 22*a* of the suction passage 22, and flows into the pump chamber Pc from the other-end side pump chamber suction port 22*b*. Accordingly, the flow of the suction oil sucked into the suction passages 12 and 22 from the suction port 12*a* is directed by the directional wall 16*a* to divert from the flow of the return oil returned from return passage 15. As a result, direct collision between the suction oil and the return oil is suppressed or prevented, turbulence in oil flows and pressure loss are suppressed, and pump efficiency is improved.

As described above, according to the pump device M1 according to the first embodiment, it is possible to suppress turbulence in fluid flows and pressure loss and improve pump efficiency while achieving simplification of structure, reduction in the number of components, and cost reduction.

Figure 10:
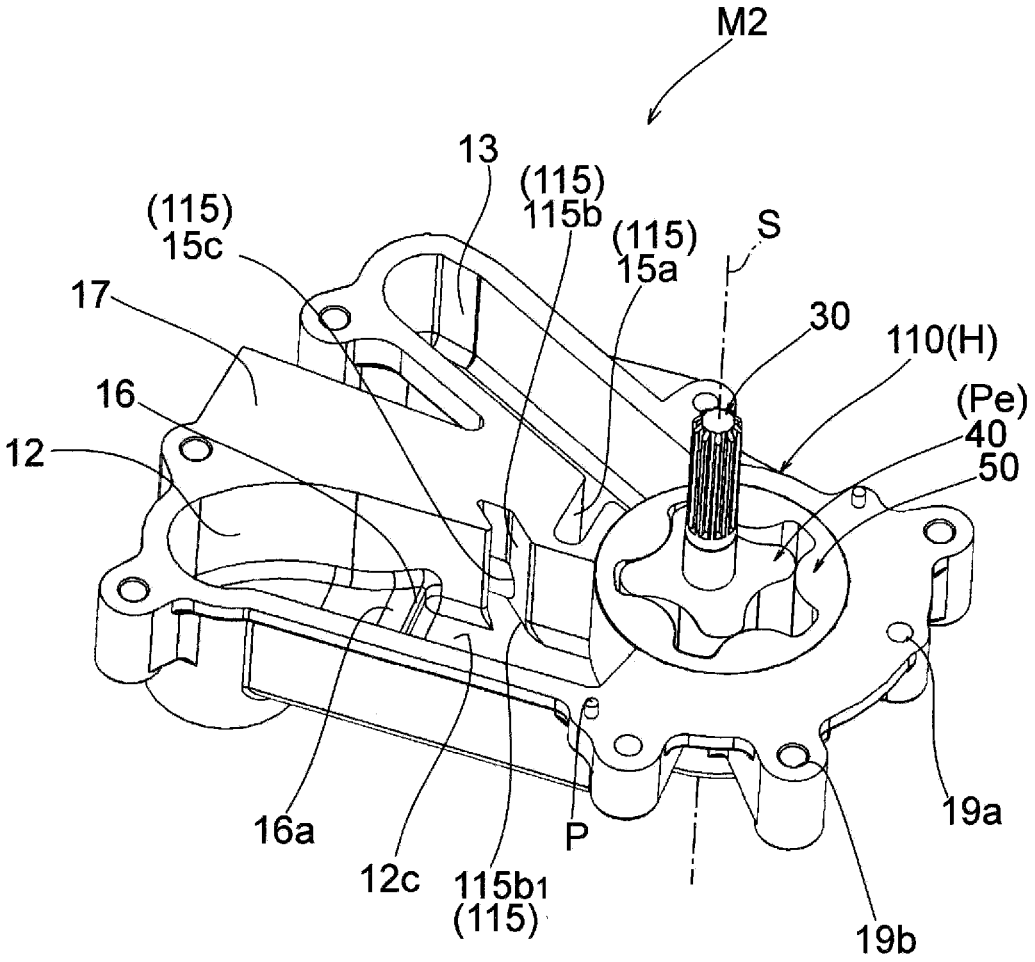
FIG. 10 shows a pump device according to a second embodiment of the disclosure, and is a perspective view viewed obliquely from above with the housing cover constituting the housing being removed.
Figure 11:
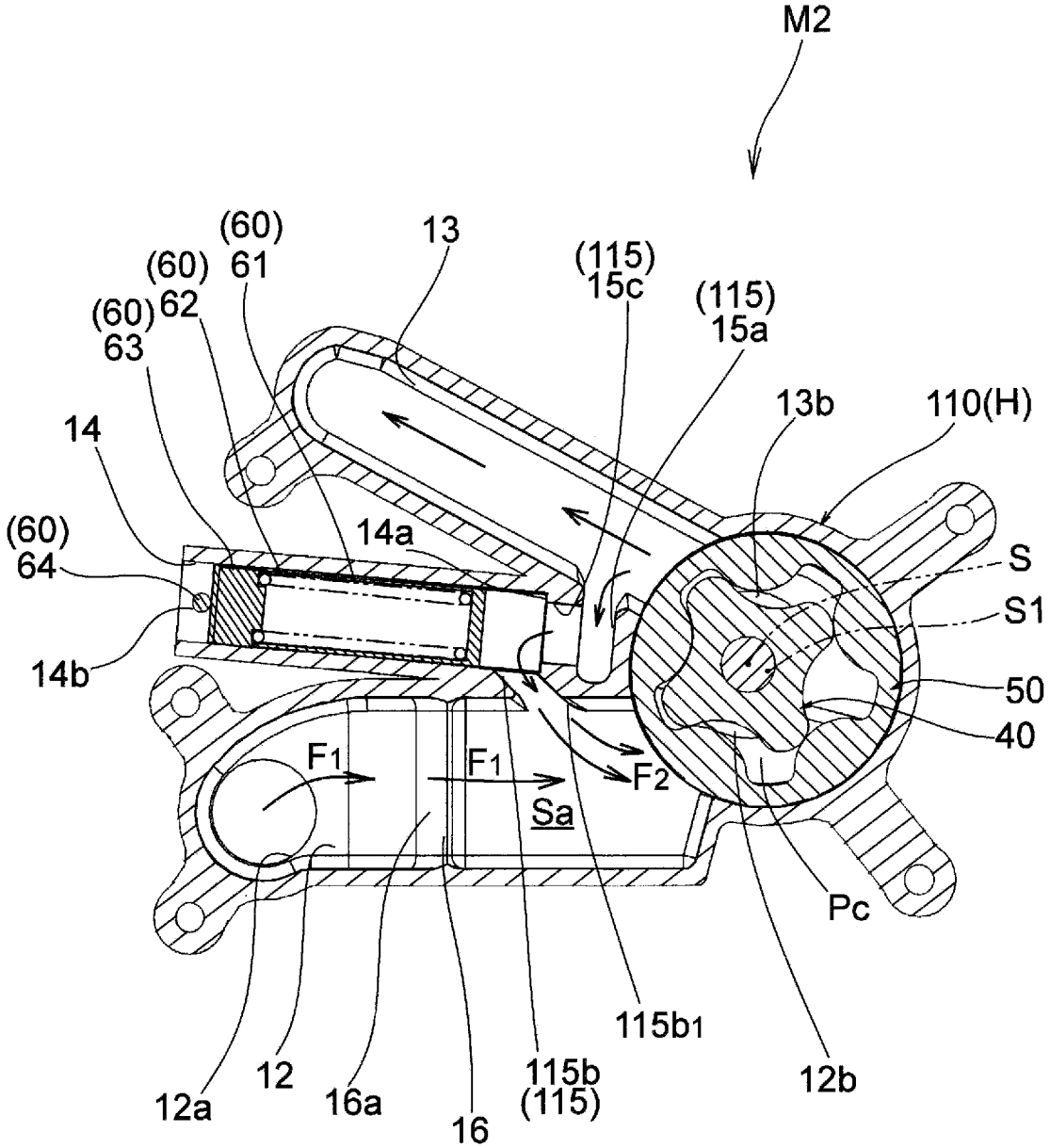
FIG. 11 is a cross-sectional view of the pump device according to the second embodiment taken along a plane (the horizontal plane in the state of being applied to the application target) perpendicular to the axis of the rotating shaft, with the on-off valve being opened.

FIG. 10 and FIG. 11 show a pump device M2 according to a second embodiment of the disclosure, which has the same configuration as the first embodiment except that the housing body of the first embodiment is changed to a housing body 110. The same components as in the first embodiment will be labeled with the same reference signs, and descriptions thereof will be omitted. The pump device M2 includes a housing body 110 and a housing cover 20 as a housing H, a rotating shaft 30 centered on an axis S, an inner rotor 40 and an outer rotor 50 as a pump element Pe, an on-off valve 60, and screws b for fastening the housing cover 20 to the housing body 110.

The housing body 110 includes a pump accommodating recess 11, a suction passage 12, a discharge passage 13, a valve accommodating part 14, a return passage 115, a weir part 16 forming a directional wall 16*a*, a joint surface 17, a bearing hole 18, three screw holes 19*a*, and five insertion holes 19*b*.

The return passage 115 is composed of an upstream passage 15*a*, a downstream passage 115*b* forming a grooved passage having a substantially rectangular cross-section opened upward in the vertical direction Vd, and an intermediate passage 15*c* defined by a part of the valve accommodating part 14 between the upstream passage 15*a* and the downstream passage 115*b*. The downstream passage 115*b* of the return passage 115 extends obliquely and is opened toward the downstream side of a position (a position shown in FIG. 8) orthogonal to the suction passage 12. Further, an opening 115*b*1 of the downstream passage 115*b* is formed along a bottom wall 12*c* of the suction passage 12 located downstream of the weir part 16, i.e., along the bottom wall 12*c* of a reservoir region Sa.

According to the pump device M2 according to the second embodiment, as shown in FIG. 11, the return oil returned from the return passage 115 obliquely flows downstream into and joins the suction passages 12 and 22. Thus, similar to the first embodiment, it is possible to prevent the return oil from colliding with the suction oil sucked from the suction port 12*a* and suppress collision with the inner wall surfaces of the suction passages 12 and 22.

That is, the suction oil (a streamline $F_1$) is diverted to flow upward by the directional wall 16*a* so as not to directly collide with the return oil (a streamline $F_2$), and also with the return oil (the streamline $F_2$) smoothly flowing into the suction passages 12 and 22, it is possible to suppress or prevent turbulence in flows due to collision between the oils. As a result, compared to the pump device M1 of the first embodiment, pressure loss in the suction passages 12 and 22 can be further reduced and pump efficiency can be further improved.

As described above, according to the pump device M2 according to the second embodiment, turbulence in fluid flows and pressure loss can be suppressed and pump efficiency can be improved while achieving simplification of structure, reduction in the number of components, and cost reduction.

Figure 12:
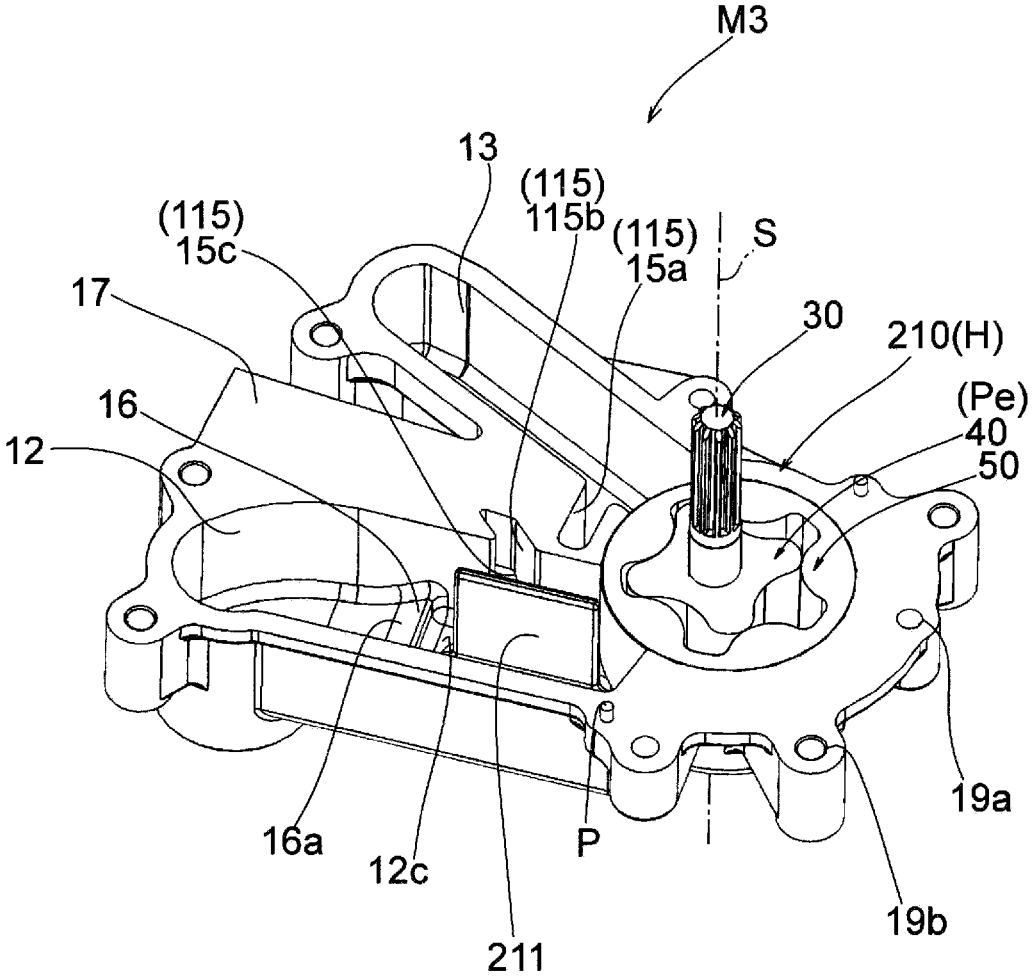
FIG. 12 shows a pump device according to a third embodiment of the disclosure, and is a perspective view viewed obliquely from above with the housing cover constituting the housing being removed.
Figure 13:
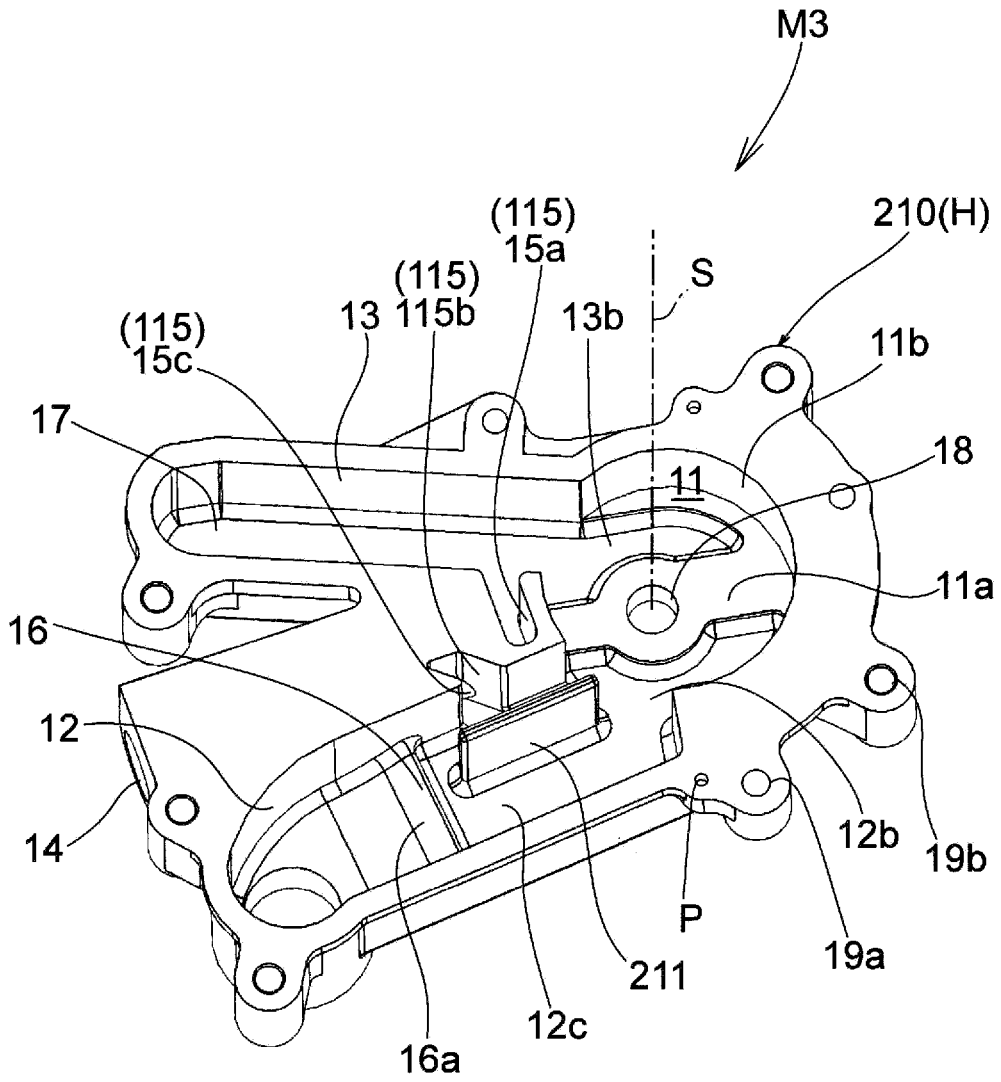
FIG. 13 is a perspective view of the housing body constituting the housing in the pump device according to the third embodiment, viewed obliquely from above.
Figure 14:
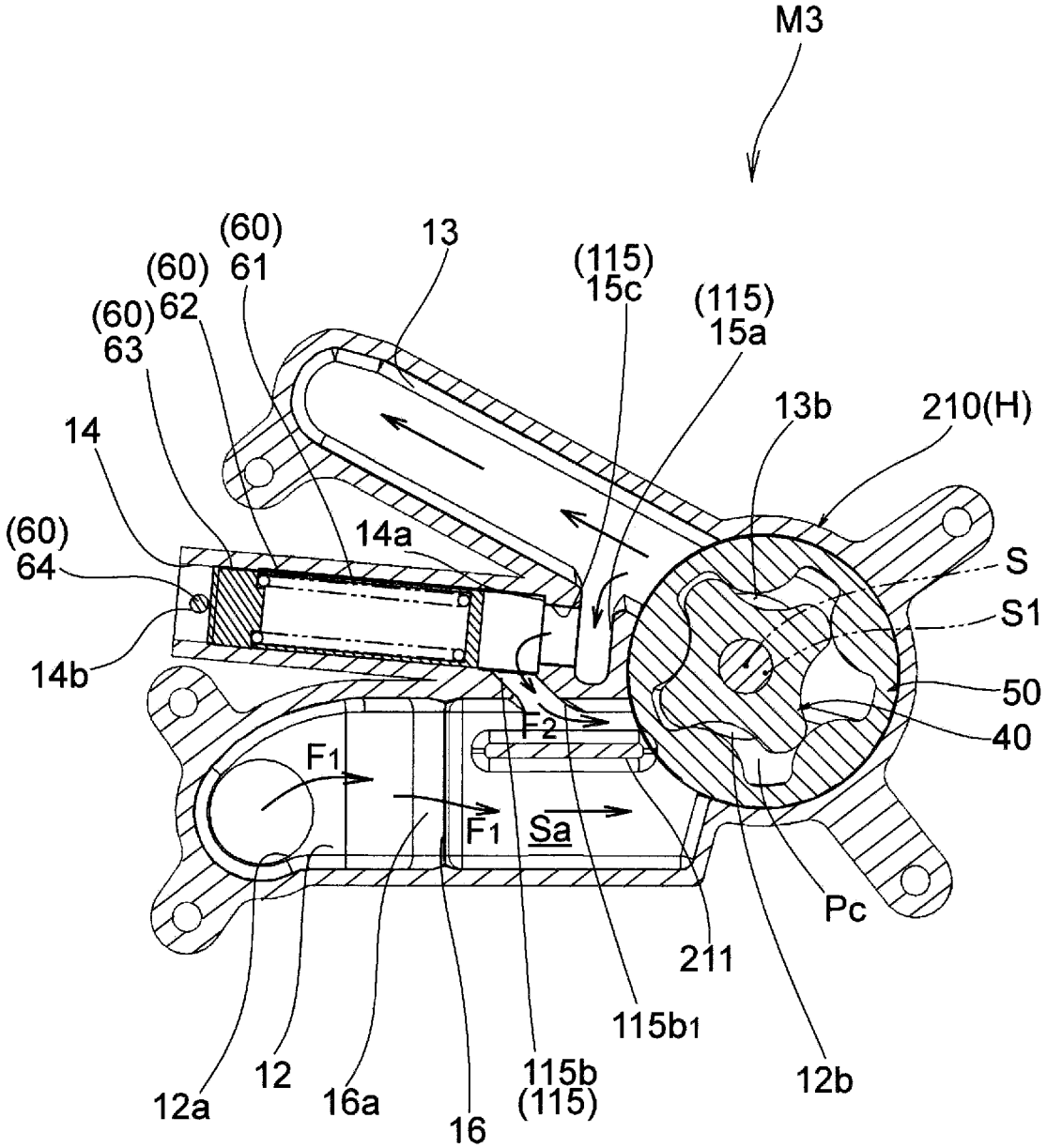
FIG. 14 is a cross-sectional view of the pump device according to the third embodiment taken along a plane (the horizontal plane in the state of being applied to the application target) perpendicular to the axis of the rotating shaft, with the on-off valve being opened.

FIG. 12 to FIG. 14 show a pump device M3 according to a third embodiment of the disclosure, which has the same configuration as the second embodiment except that the housing body 110 of the second embodiment is changed to a housing body 210. The same components as in the first embodiment and the second embodiment will be labeled with the same reference signs, and descriptions thereof will be omitted. The pump device M3 includes a housing body 210 and a housing cover 20 as a housing H, a rotating shaft 30 centered on an axis S, an inner rotor 40 and an outer rotor 50 as a pump element Pe, an on-off valve 60, and screws b for fastening the housing cover 20 to the housing body 210.

The housing body 210 includes a pump accommodating recess 11, a suction passage 12, a discharge passage 13, a valve accommodating part 14, a return passage 115, a weir part 16 forming a directional wall 16*a*, a joint surface 17, a bearing hole 18, three screw holes 19*a*, five insertion holes 19*b*, and a flow regulating wall 211.

In a predetermined region including an opening 115*b*1 at which a downstream passage 115*b* of the return passage 115 is opened to the suction passage 12, the flow regulating wall 211 protrudes in the direction of the axis S from a bottom wall 12*c* of a reservoir region Sa and is formed in a substantially rectangular flat plate shape elongated in the extending direction of the suction passage 12, to regulate the return oil returned from the downstream passage 115*b* of the return passage 115 to flow along the suction passage 12.

The flow regulating wall 211 forces the return oil returned from the return passage 115 (the downstream passage 115*b*) to change direction toward the downstream side of the suction passage 12. Accordingly, the return oil is isolated from the suction oil sucked into the suction passages 12 and 22 from the suction port 12*a*, and collision between the two oils can be more effectively suppressed.

That is, the suction oil (a streamline $F_1$) is diverted to flow upward by the directional wall 16*a* so as not to collide directly with the return oil (a streamline $F_2$), and with the return oil (the streamline $F_2$) smoothly flowing into the suction passages 12 and 22 and regulated by the flow regulating wall 221, it is possible to further suppress or prevent turbulence in flows due to collision between the oils. As a result, compared to the pump device M2 of the second embodiment, pressure loss in the suction passages 12 and 22 can be further reduced and pump efficiency can be further improved.

Further, the housing H has a two-part structure including the housing body 210 and the housing cover 20, and in the suction passage 12 of the housing body 210, similar to the weir part 16, the flow regulating wall 211 is formed to protrude in the direction of the axis S from the bottom wall 12*c* of the suction passage 12. Accordingly, by providing the flow regulating wall 211 which protrudes from the bottom wall 12*c* of the suction passage 12 forming a grooved passage in the housing body 210, the weir part 16, the directional wall 16*a*, and the flow regulating wall 211 can be easily formed integrally as a part of the housing body 210.

As described above, according to the pump device M3 according to the third embodiment, turbulence in fluid flows and pressure loss can be suppressed and pump efficiency can be improved while achieving simplification of structure, reduction in the number of components, and cost reduction.

FIG. 15 to FIG. 18 respectively show experimental results of modeling, for analyzing flows of fluids, a pump device without a weir part and a directional wall as a comparative example, and the pump devices M1, M2, and M3 according to the first to third embodiments, and simulating the flows of fluids.

Figure 15:
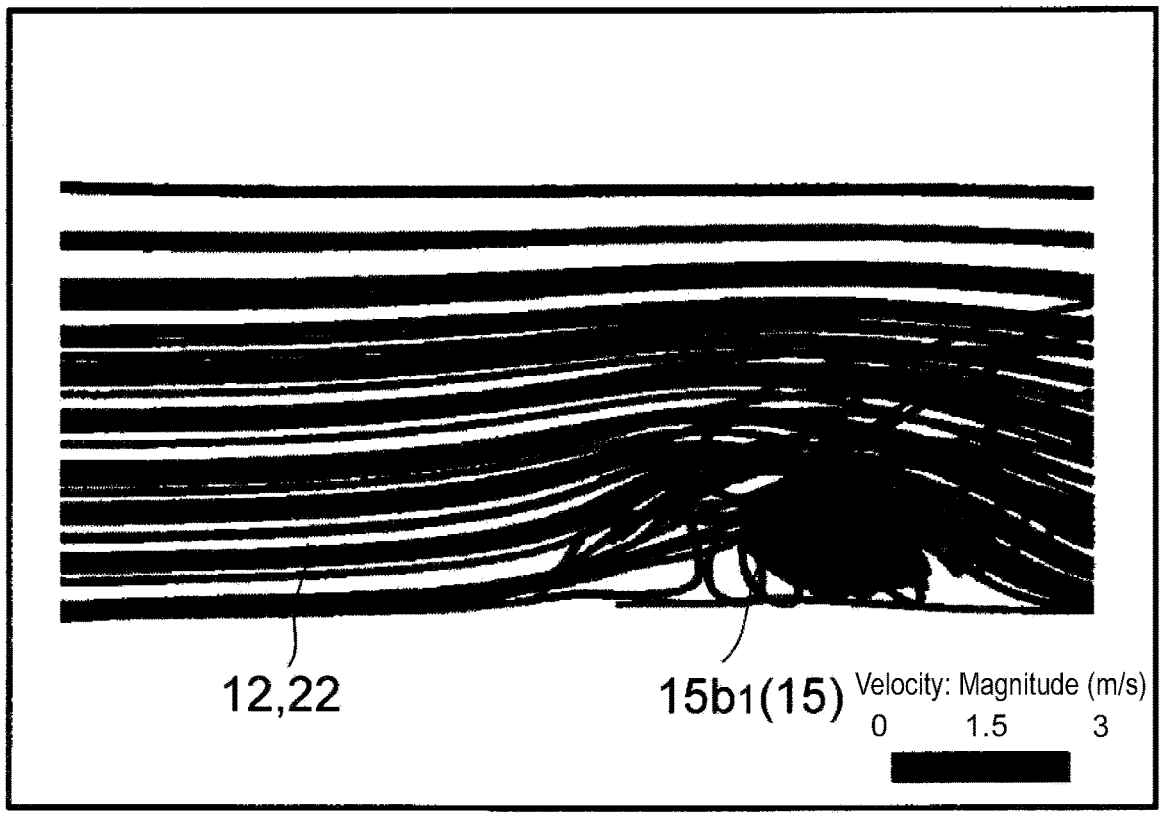
FIG. 15 shows a state of fluid flows in the suction passage in a pump device as a comparative example, with the upper side being a streamline diagram at a vertical cross-section parallel to the axis of the rotating shaft, and the lower side being a streamline diagram at a horizontal cross-section perpendicular to the axis of the rotating shaft.
Figure 15:
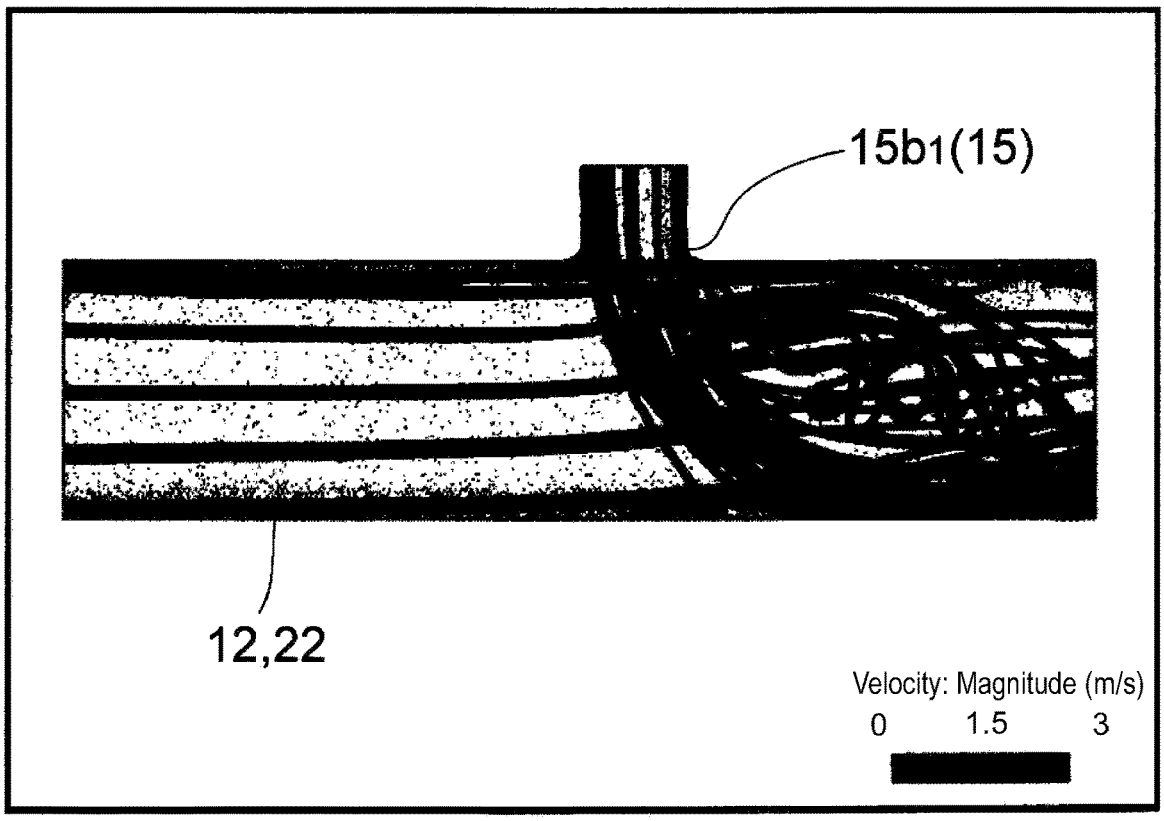
Figure 16:
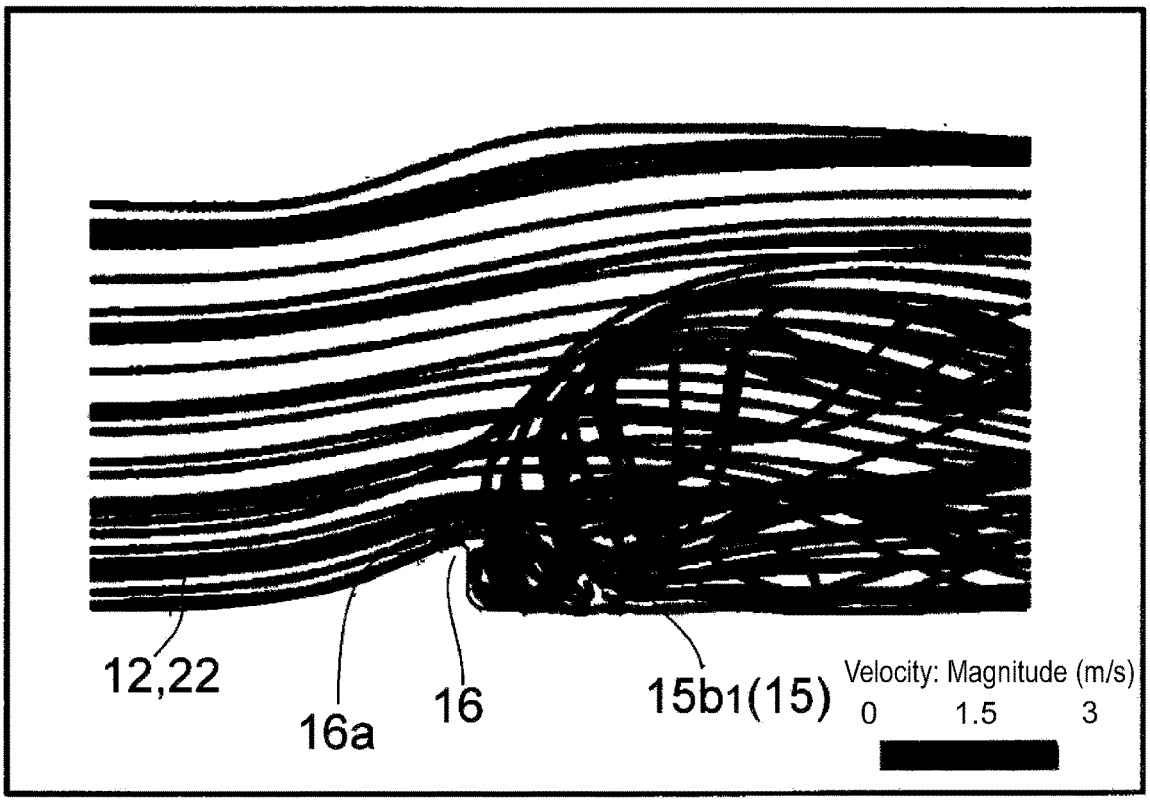
FIG. 16 shows a state of fluid flows in the suction passage in the pump device according to the first embodiment, with the upper side being a streamline diagram at a vertical cross-section parallel to the axis of the rotating shaft, and the lower side being a streamline diagram at a horizontal cross-section perpendicular to the axis of the rotating shaft.
Figure 16:
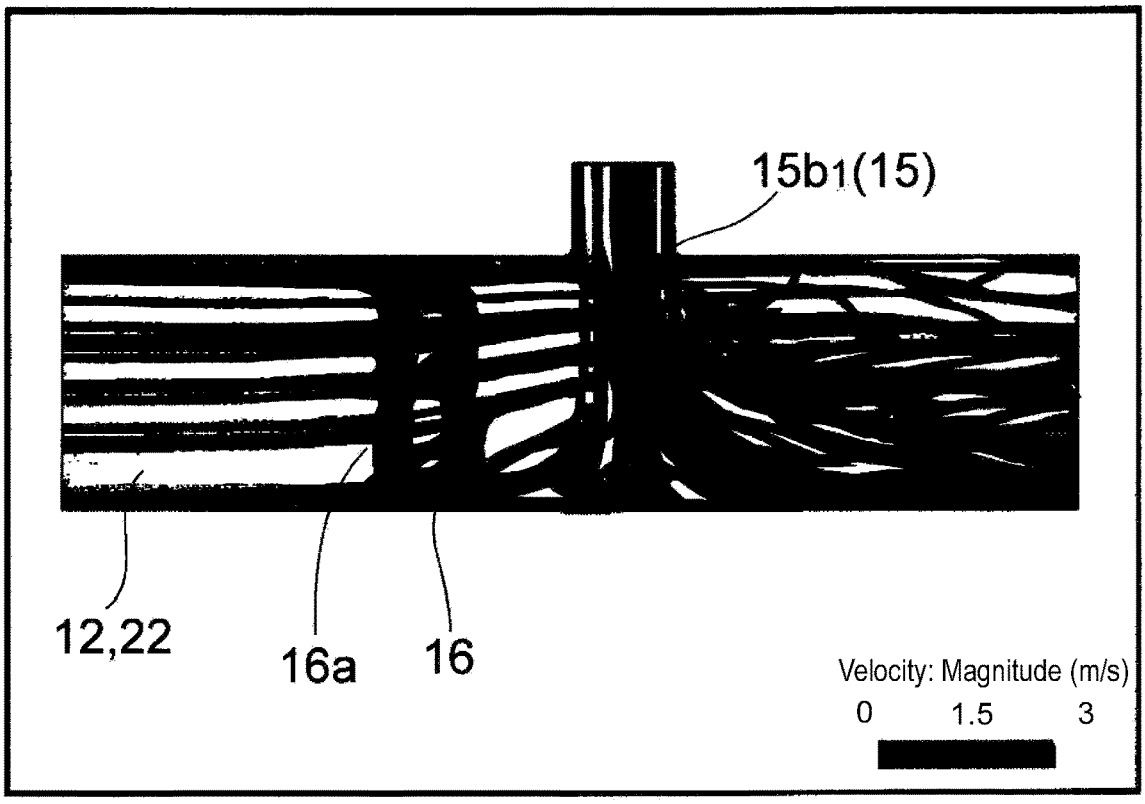
Figure 17:
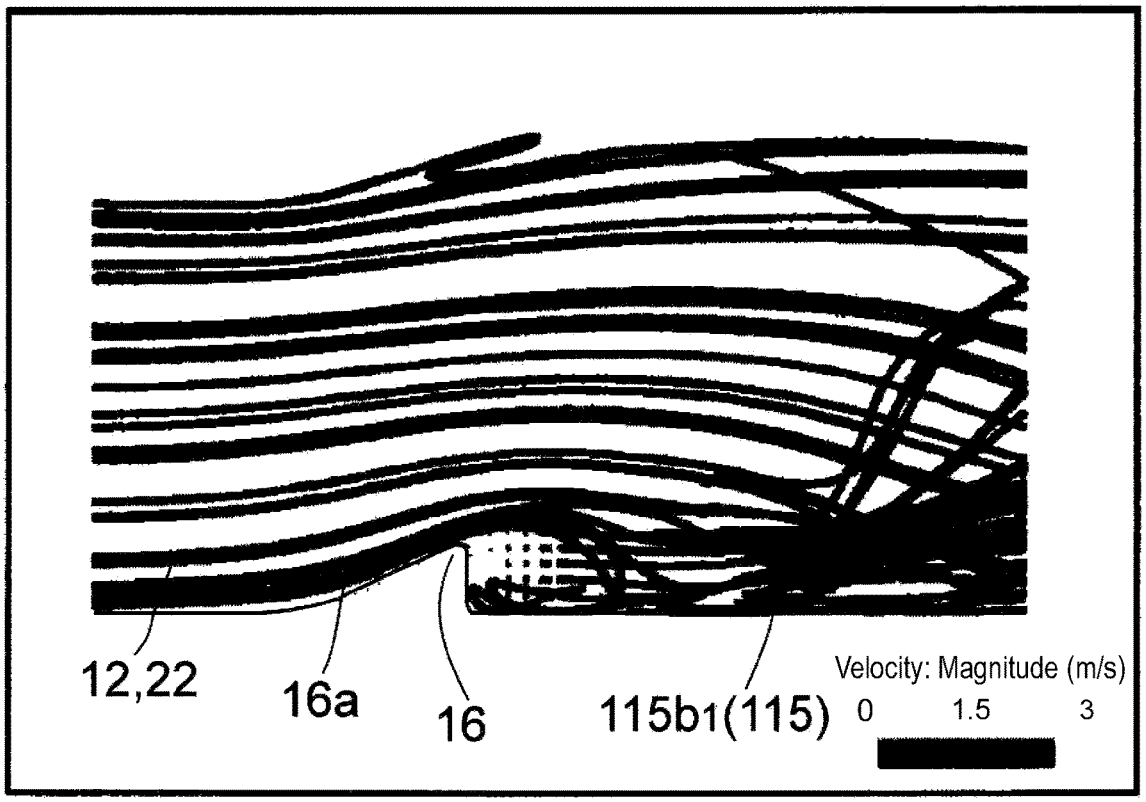
FIG. 17 shows a state of fluid flows in the suction passage in the pump device according to the second embodiment, with the upper side being a streamline diagram at a vertical cross-section parallel to the axis of the rotating shaft, and the lower side being a streamline diagram at a horizontal cross-section perpendicular to the axis of the rotating shaft.
Figure 17:
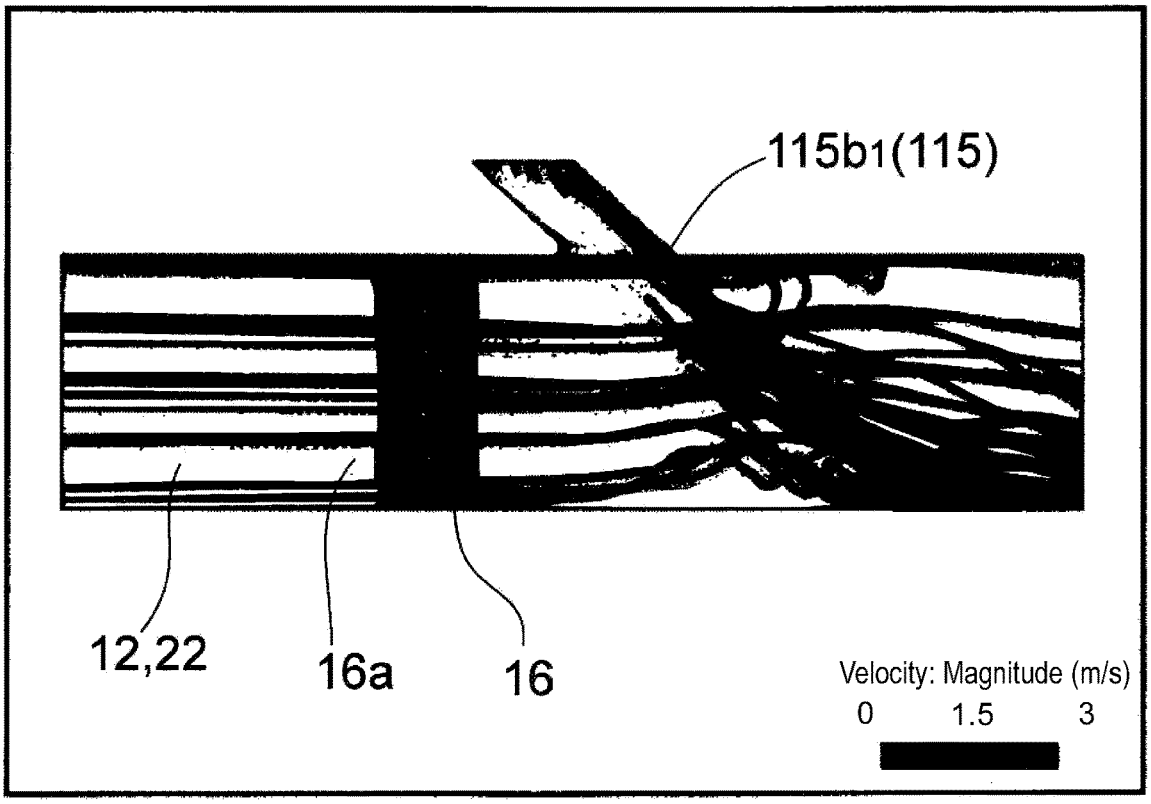
Figure 18:
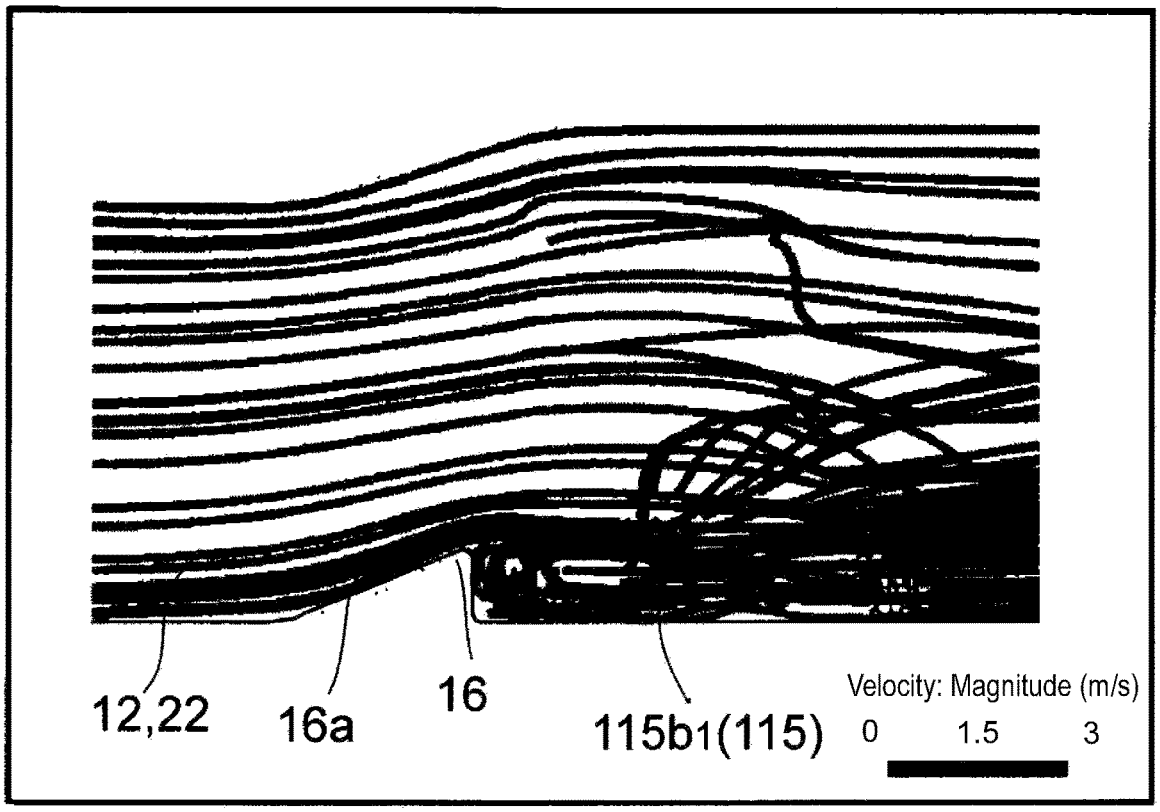
FIG. 18 shows a state of fluid flows in the suction passage in the pump device according to the third embodiment, with the upper side being a streamline diagram at a vertical cross-section parallel to the axis of the rotating shaft, and the lower side being a streamline diagram at a horizontal cross-section perpendicular to the axis of the rotating shaft.
Figure 18:
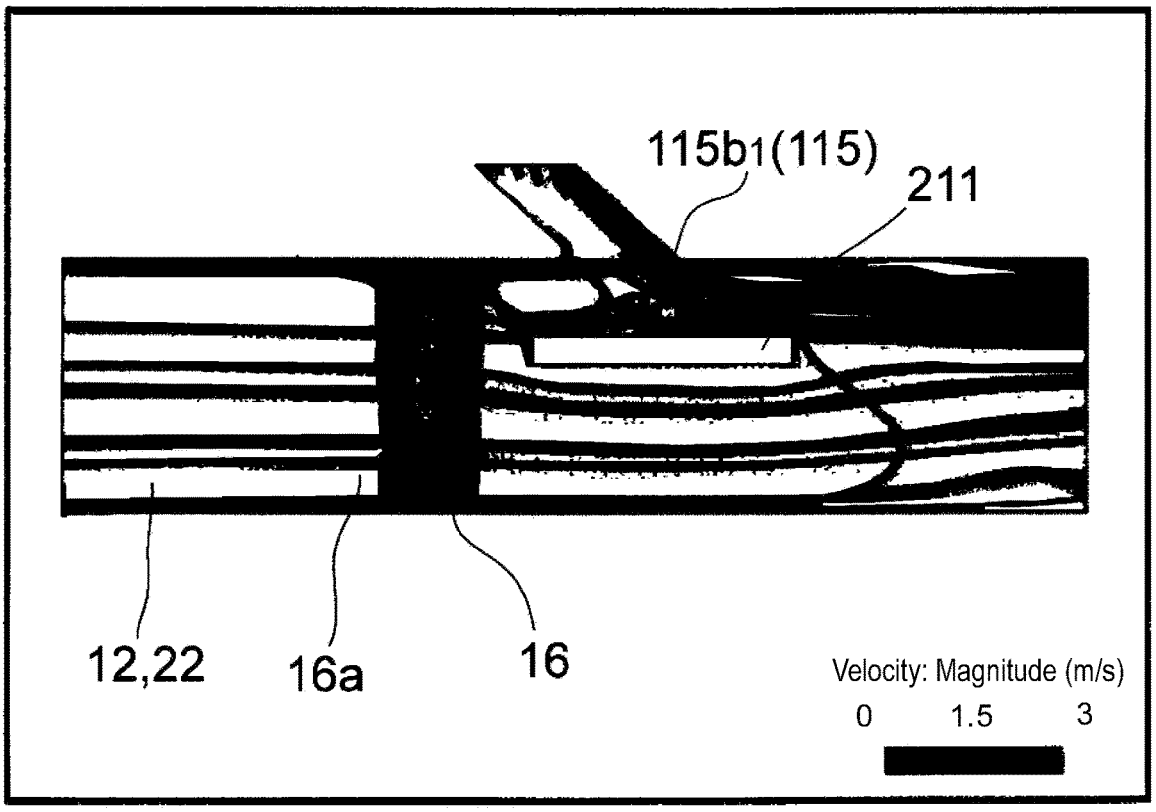

According to the results, in the comparative example, as shown in FIG. 15, the suction fluid and the return fluid collide violently, and the streamlines overlap to generate a vortex flow in a blackish region. In the first embodiment (the weir part 16 and the directional wall 16*a*), as shown in FIG. 16, the directional wall 16*a* directs the suction fluid to flow obliquely upward downstream, and collision between the fluids is gentler than in the comparative example. In the second embodiment (the weir part 16, the directional wall 16*a*, and the downstream passage 115*b* of the return passage 115 being opened toward the downstream side), as shown in FIG. 17, the return fluid smoothly flows along the suction passage 12, and collision between the fluids is gentler than in the first embodiment. In the third embodiment (the weir part 16, the directional wall 16*a*, the downstream passage 115*b* of the return passage 115 being opened toward the downstream side, and the flow regulating wall 211), as shown in FIG. 18, the return fluid is regulated by the flow regulating wall 211 to flow along the suction passage 12 and flows more smoothly, and collision between the fluids is gentler than in the second embodiment.

Figure 19:
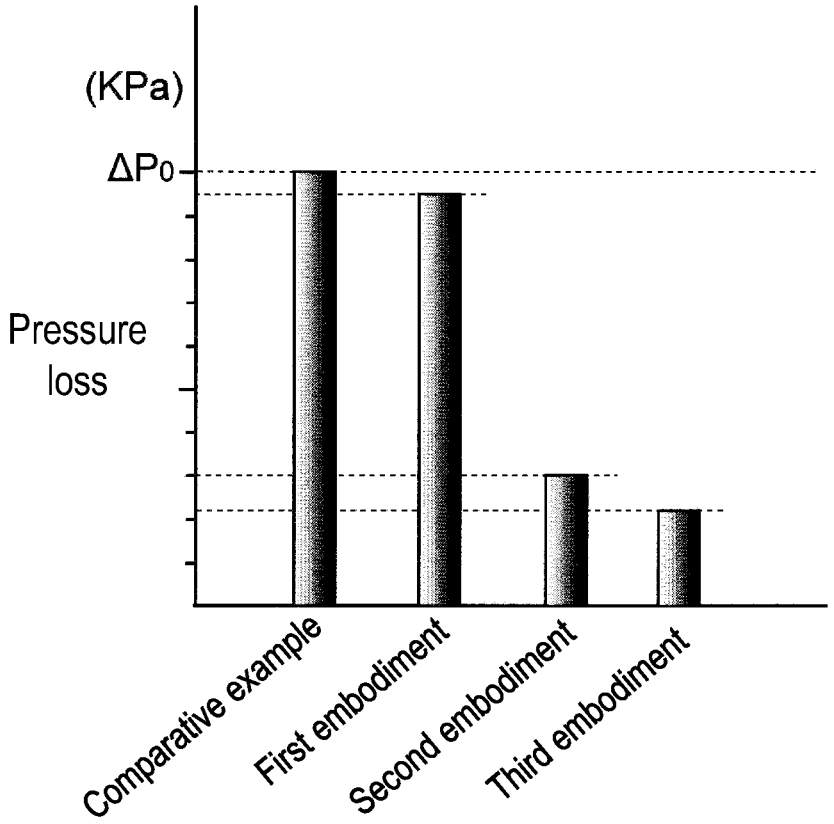
FIG. 19 is a graph showing pressure losses in the pump devices according to the first to third embodiments of the disclosure and the pump device as the comparative example.

FIG. 19 is a graph showing pressure losses obtained respectively in the experimental results of the simulations shown in FIG. 15 to FIG. 18. The pressure loss is represented by a value ΔP of "$P_{in}$-$P_{out}$" obtained by subtracting a pressure $P_{out}$ (kPa) at the downstream end from a pressure $P_{in}$(kPa) at the upstream end of the suction passages 12 and 22. Based on a value $\Delta P_0$ of the comparative example, the values in the first to third embodiments are represented as ratios to $\Delta P_0$. According to this experiment, the pressure loss of the first embodiment is smaller than that of the comparative example, the pressure loss of the second embodiment is smaller than that of the first embodiment, and the pressure loss of the third embodiment is smaller than that of the second embodiment.

As described above, by providing, at the weir part 16, the directional wall 16*a* which directs the flow of the suction fluid sucked into the suction passages 12 and 22 from the suction port 12*a* to divert from the flow of the return fluid returned from the return passage 15, turbulence in fluid flows and pressure loss can be suppressed, and thus pump efficiency can be improved. Further, in addition to the directional wall 16*a*, by configuring the return passage 15 to be opened toward the downstream side of the suction passage 12 and further providing the flow regulating wall 211, turbulence in fluid flows and pressure loss can be further suppressed, and thus pump efficiency can be further improved.

In the above embodiments, it has been shown that the directional wall provided in the housing is the directional wall 16*a* which forms an inclined surface formed on the upper surface of the weir part 16 protruding from the bottom wall 12*c* of the suction passage 12, but the disclosure is not limited thereto. As long as the flow of suction fluid sucked into the suction passage from the suction port is directed to be diverted from the flow of return fluid returned from the return passage, a directional wall in another form may also be adopted.

In the above embodiments, it has been shown that the housing is the housing H which is composed of the housing body 10, 110, or 210 and the housing cover 20, but the disclosure is not limited thereto. As long as the structure can be provided with the directional wall, the weir part, the return passage, and the flow regulating wall, a housing in another form or having another divided structure may also be adopted.

In the above embodiments, the outboard motor A has been shown as the application target to which the pump device of the disclosure is applied, but the disclosure is not limited thereto. The pump device may also be applied to another fluid circulation or supply device, or an application target having another configuration structure.

As described above, according to the pump device of the disclosure, turbulence in fluid flows and pressure loss can be suppressed and pump efficiency can be improved while achieving simplification of structure, reduction in the number of components, and cost reduction. Thus, the pump device may of course be applied to internal combustion engines mounted on outboard motors, but is also useful in vehicles mounted with other engines, or other devices that require pumping of hydraulic or lubricating oil.

What is claimed is:

1. A pump device comprising:

a housing which comprises a suction passage defining a suction port at an upstream end, a discharge passage defining a discharge port at a downstream end, and a return passage returning a part of a fluid flowing through the discharge passage to midway of the suction passage;

a pump element which is accommodated in the housing and rotates around a predetermined axis to suck, pressurize, and discharge a fluid; and an on-off valve which opens and closes the return passage, wherein in the suction passage upstream of an opening at which the return passage is opened to the suction passage, the housing comprises a directional wall which directs a flow of a suction fluid sucked into the suction passage from the suction port to divert from a flow of a return fluid returned from the return passage, wherein in the suction passage upstream of the opening at which the return passage is opened to the suction passage, the housing comprises a weir part which protrudes from a bottom wall of the suction passage and defines a reservoir region storing a fluid in a region that comprises the opening, and the weir part comprises an inclined surface forming an upward slope toward a downstream side to define the directional wall.

2. The pump device according to claim 1, wherein the opening of the return passage is formed along a bottom wall of the reservoir region.

3. The pump device according to claim 1, wherein the return passage is opened toward a downstream side of a position orthogonal to the suction passage.

4. The pump device according to claim 1, wherein in a predetermined region comprising the opening at which the return passage is opened to the suction passage, the housing comprises a flow regulating wall protruding from a bottom wall of the reservoir region to regulate the return fluid returned from the return passage to flow along the suction passage.

5. The pump device according to claim 1, wherein the suction port is opened downward in a vertical direction in a use state of being applied to an application target.

6. The pump device according to claim 5, wherein the discharge port is opened upward in the vertical direction in the use state.

7. The pump device according to claim 5, wherein the housing comprises a housing body which is opened upward in the vertical direction in the use state, and a housing cover which is coupled to close the housing body from above.

8. The pump device according to claim 7, wherein the housing body comprises: a pump accommodating recess opened upward in the vertical direction to accommodate the pump element; a grooved passage opened upward in the vertical direction to define a part of the suction passage, the discharge passage, and the return passage; and the weir part formed in the grooved passage.

9. The pump device according to claim 8, wherein the housing cover comprises a grooved passage opened downward in the vertical direction to define a part of the suction passage and the discharge passage.

10. The pump device according to claim 9, wherein the housing comprises pump chamber suction ports for sucking a fluid into a pump chamber of the pump element at two end surfaces of the pump element in a direction of the axis.

11. The pump device according to claim 10, wherein the pump chamber suction ports comprise: a one-end side pump chamber suction port formed to face one end surface of the pump element at a downstream end of the suction passage of the housing body; and an other-end side pump chamber suction port formed to face another end surface of the pump element at a downstream end of the suction passage of the housing cover.

12. The pump device according to claim 11, wherein the suction passage of the housing cover comprises an inclined surface inclined in a same direction as the inclined surface of the weir part formed in the housing body.

13. The pump device according to claim 1, wherein the housing is formed so that the suction passage and the discharge passage are arranged in a V-shape with the pump element as a boundary.

14. The pump device according to claim 13, wherein the housing comprises the return passage and a valve accommodating part which accommodates the on-off valve in a region sandwiched between the suction passage and the discharge passage.

15. The pump device according to claim 1, wherein the pump element comprises: an inner rotor which rotates integrally with a rotating shaft rotatably supported around the axis with respect to the housing; and an outer rotor which rotates in conjunction with the inner rotor.

16. The pump device according to claim 15, wherein the inner rotor and the outer rotor are trochoidal rotors having a trochoidal tooth profile.

* * * * *